US006975336B2

(12) United States Patent
Ito

(10) Patent No.: US 6,975,336 B2
(45) Date of Patent: Dec. 13, 2005

(54) LIQUID CRYSTAL DEVICE AND ELECTRO-OPTICAL DEVICE, DRIVING CIRCUIT AND DRIVE METHOD THEREFOR, AND ELECTRONIC APPARATUS

(75) Inventor: Akihiko Ito, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 470 days.

(21) Appl. No.: 10/309,199

(22) Filed: Dec. 4, 2002

(65) Prior Publication Data

US 2003/0174111 A1 Sep. 18, 2003

(30) Foreign Application Priority Data

Dec. 5, 2001 (JP) ..... 2001-371849
Nov. 26, 2002 (JP) ..... 2002-342503

(51) Int. Cl.[7] ..... G09G 3/30; G09G 3/36; G09G 5/10

(52) U.S. Cl. ..... 345/690; 345/77; 345/89; 345/94; 345/642; 345/694

(58) Field of Search ..... 345/77, 87, 89, 345/94, 690–694

(56) References Cited

U.S. PATENT DOCUMENTS 5,111,194 A * 5/1992 Oneda ..... 345/690
5,189,406 A * 2/1993 Humphries et al. ..... 345/693
5,262,881 A * 11/1993 Kuwata et al. ..... 345/94
5,621,425 A * 4/1997 Hoshino et al. ..... 345/94
5,861,869 A * 1/1999 Scheffer et al. ..... 345/691
5,929,832 A * 7/1999 Furukawa et al. ..... 345/98
6,040,826 A * 3/2000 Furukawa ..... 345/534
6,154,189 A 11/2000 Tamura et al.
6,452,578 B1 * 9/2002 Ito et al. ..... 345/94
6,556,180 B1 * 4/2003 Furuhashi et al. ..... 345/87
6,597,355 B1 7/2003 Yasunishi et al.
6,646,654 B2 * 11/2003 Takagi ..... 345/690
6,661,400 B2 * 12/2003 Sakashita ..... 345/89
6,771,242 B2 * 8/2004 Ham ..... 345/89
6,774,916 B2 * 8/2004 Pettitt et al. ..... 345/691

FOREIGN PATENT DOCUMENTS

JP 10-133630 5/1998
JP A 10-143120 5/1998
JP A 10-301545 11/1998
JP 10-301545 11/1998
JP A 052333 2/1999
JP A 11-149278 6/1999
JP A 11-249104 9/1999

(Continued)

*Primary Examiner*—Regina Liang
*Assistant Examiner*—Duc Q DInh
(74) *Attorney, Agent, or Firm*—Oliff & Berridge, PLC

(57) ABSTRACT

The invention relates to a device and methods to reduce the number of voltage levels of a data signal and to simplify a generation process therefor when gray-scale display is performed using an MLS driving method. The device can include a scanning-electrode driving circuit that selects three scanning electrodes n times every vertical scanning period. At each selection, selection voltages in accordance with three column elements, corresponding to the selection, of a 3-row n-column scanning pattern can be applied to the scanning electrodes. In each selection period in which three scanning electrodes are selected, a signal-electrode driving circuit can compare a bit string in accordance with the column elements corresponding to the selection of the scanning pattern with each of bit strings, which consists of a bit in each position of pieces of gray-scale data D for three pixels at the intersections of a signal electrode and the three scanning electrodes, and conversion data Dt is generated in accordance with the comparison results. In each selection period, the voltage +Vx is applied to the signal electrode for a period in accordance with the conversion data Dt, and the voltage −Vx is applied to the signal electrode for the remaining period.

15 Claims, 16 Drawing Sheets

FOREIGN PATENT DOCUMENTS

| | | |
|---|---|---|
| JP | A 11-258575 | 9/1999 |
| JP | 2000-258751 | 9/2000 |
| JP | A 2001-249638 | 7/2001 |
| JP | A 2001-236044 | 8/2001 |
| JP | 2001-249638 | 9/2001 |
| KR | 199-071872 | 10/1998 |
| KR | 1998-071872 | 10/1998 |

* cited by examiner

FIG. 9A

| CONVERSION DATA | 0 | 1 | 2 | 3 | 4 | 5 | 6 |
|---|---|---|---|---|---|---|---|
| (000) | 0 | 0 | 0 | 0 | 0 | 0 | 0 |
| (001) | 0 | 0 | 0 | 0 | 0 | 0 | 1 |
| (010) | 0 | 0 | 0 | 0 | 0 | 1 | 1 |
| (011) | 0 | 0 | 0 | 0 | 1 | 1 | 1 |
| (100) | 0 | 0 | 0 | 1 | 1 | 1 | 1 |
| (101) | 0 | 0 | 1 | 1 | 1 | 1 | 1 |
| (110) | 0 | 1 | 1 | 1 | 1 | 1 | 1 |
| (111) | 1 | 1 | 1 | 1 | 1 | 1 | 1 |

FIG. 9B

| CONVERSION DATA | 0 | 1 | 2 | 3 | 4 | 5 | 6 |
|---|---|---|---|---|---|---|---|
| (000) | 0 | 0 | 0 | 0 | 0 | 0 | 0 |
| (001) | 1 | 0 | 0 | 0 | 0 | 0 | 0 |
| (010) | 1 | 1 | 0 | 0 | 0 | 0 | 0 |
| (011) | 1 | 1 | 1 | 0 | 0 | 0 | 0 |
| (100) | 1 | 1 | 1 | 1 | 0 | 0 | 0 |
| (101) | 1 | 1 | 1 | 1 | 1 | 0 | 0 |
| (110) | 1 | 1 | 1 | 1 | 1 | 1 | 0 |
| (111) | 1 | 1 | 1 | 1 | 1 | 1 | 1 |

FIG. 19

$$\frac{\sum_{i=1}^{L}\{L \times Di - (N-1) \times L/2\} \times Fi + L \times (N-1) \times L/2}{L}$$

L: NUMBER OF SIMULTANEOUSLY SELECTED ELECTRODES

N: NUMBER OF GRAY LEVELS

F: ORTHOGONAL COEFFICIENT

D: GRAY-SCALE DATA

LIQUID CRYSTAL DEVICE AND ELECTRO-OPTICAL DEVICE, DRIVING CIRCUIT AND DRIVE METHOD THEREFOR, AND ELECTRONIC APPARATUS

BACKGROUND OF THE INVENTION

1. Field of Invention

The present invention relates to liquid crystal devices for performing gray-scale display by simultaneously selecting a plurality of scanning electrodes, electro-optical devices, driving circuits and driving methods therefor, and electronic apparatuses.

2. Description of Related Art

Currently, liquid crystal devices can be classified into various types depending on the electrode configuration and driving methods. For example, matrix liquid crystal devices can generally be classified into two types: 1) active matrix devices using switching elements, such as transistors, and diodes, and 2) passive matrix devices not using switching elements. Of the two types, passive matrix devices do not use switching elements, and are thus advantageous in that they are suitable for reducing power consumption and can be manufactured easily at low cost.

A known driving method for such passive matrix liquid crystal devices involves simultaneously selecting a plurality of scanning electrodes in order to increase contrast and to achieve low-voltage driving (hereinafter referred to as an "MLS driving method").

In the driving method involving simultaneously selecting a plurality of scanning electrodes, as the number of scanning electrodes to be simultaneously selected increases, so does the number of voltage levels available for a data signal to be supplied to a signal electrode. For example, when a method for simultaneously selecting four scanning electrodes is used, a data signal can be at five voltage levels. When the number of voltage levels of each data signal increases, the configuration of a signal electrode driving circuit becomes more complicated, or the manufacturing cost or the power consumption increase.

By way of example, Japanese Unexamined Patent Publication H10-133630 discloses a technology for solving the above-described problems caused by an increase in the number of voltages and performing gray-scale display using the MLS driving method. According to the technology disclosed, the calculation shown in FIG. 19 is performed wherein L denotes the number of simultaneously-selected electrodes, N denotes the number of gray levels, D denotes gray-scale data, and F denotes an orthogonal coefficient, thus obtaining data indicating, for how long, which of two voltage types should be applied to a signal electrode. Accordingly, gray-scale display can be performed while reducing the number of voltage levels of each data signal. Adoption of this technology requires an arithmetic circuit for performing the complicated calculation processing shown in FIG. 19. As a result, additional problems such as an increase in the manufacturing cost and an increase in the circuit size accompanied with more complicated circuit configuration occur.

SUMMARY OF THE INVENTION

In view of the above-described circumstances, it is an object of the present invention to provide a liquid crystal device for reducing the number of voltage levels of each data signal and simplifying the processing for generating each data signal when performing gray-scale display using an MLS driving method, an electro-optical device, a driving circuit and a driving method therefor, and an electronic apparatus using the liquid crystal device.

In order to solve the above-described problems, the present invention can provide a driving method for a liquid crystal device for causing pixels at the intersections of scanning electrodes and signal electrodes to perform gray-scale display based on pieces of gray-scale data, each piece being formed of a plurality of bits. The driving method can include selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. Further, the method can include in each selection period in which three of the scanning electrodes are selected, comparing the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and generating conversion data in accordance with the comparison results; and in the selection period, applying a first voltage to the signal electrode for a period of duration in accordance with the conversion data, and applying a second voltage differing from the first voltage to the signal electrode for the remaining period.

In the driving method, each of the bit strings in accordance with the pieces of gray-scale data corresponding to the three pixels at the intersections of the simultaneously-selected three scanning electrodes and one signal electrode can be compared with the bit string in accordance with the column elements of the scanning pattern. As a result, the conversion data for determining the voltage to be applied to the signal electrode and the application period thereof is generated. Accordingly, it becomes unnecessary to perform complicated calculation in order to determine the voltage to be applied to the signal electrode. The configuration of a circuit for driving the signal electrodes is thus simplified. Since two types of voltages are applied to the signal electrode, problems caused by an increase in the number of voltage levels applied to the signal electrode are prevented. For example, an increase in power consumption is prevented, and the circuit configuration does not become complicated.

In the driving method, a specific method involving comparison of the corresponding bits of the bit strings and generation of the conversion data may be as follows. In each selection period in which three of the scanning electrodes are selected, the bit string in accordance with the column elements of the scanning pattern, the column elements corresponding to the selection, may be compared with each of the bit strings, each bit string being formed of a bit in each position of the pieces of gray-scale data for the three pixels at the intersections of the signal electrode and the three scanning electrodes, and a bit string including bits corresponding to the number of non-conforming bits (or the number of conforming bits) obtained as a result of each comparison may be used as the conversion data.

In the driving method, it is preferable that the mode be switched, in each of the n periods, between one state in which the period in which the first voltage is applied to the signal electrode includes the start of the selection period in which the three scanning electrodes are selected and another state in which the period in which the second voltage is applied to the signal electrode includes the start of the selection period in which the three scanning electrodes are selected. Accordingly, the number of times the voltage to be applied to the signal electrode is switched is reduced, and the power consumption is further reduced.

Alternatively, the mode may be switched, in each of the n selections (fields) of three scanning electrodes, between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period. Accordingly, display unevenness due to differences in the effective values of voltages applied to liquid crystal is suppressed, and satisfactory display quality is ensured. On the basis of the same spirit, the mode may be switched, every one or more of the vertical scanning periods (frames), between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period. Alternatively, the mode may be switched, every one or more of the signal electrodes, between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period.

In order to solve the above-described problems, the present invention can also provide a driving circuit for a liquid crystal device for causing pixels at the intersections of scanning electrodes and signal electrodes to perform gray-scale display based on pieces of gray-scale data, each piece being formed of a plurality of bits. The driving circuit can include a scanning-electrode driving circuit for selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. The device can further include a conversion-data output circuit for comparing, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputting conversion data in accordance with the comparison results, and a voltage applying circuit for applying, in the selection period, a first voltage to the signal electrode for a period of duration in accordance with the conversion data and applying a second voltage differing from the first voltage to the signal electrode for the remaining period.

According to the driving circuit, for the same reasons as those described in the driving method, the number of voltage levels (of a signal) applied to the signal electrode is reduced, and the amount of calculation for generating the signal is reduced. In the driving circuit, in each selection period in which three of the scanning electrodes are selected, the conversion-data output circuit may compare the bit string in accordance with the column elements of the scanning pattern, the column elements corresponding to the selection, with each of the bit strings, each bit string being formed of a bit in each position of the pieces of gray-scale data for the three pixels at the intersections of the signal electrode and the three scanning electrodes, and may output a bit string including bits corresponding to the number of non-conforming bits (or the number of conforming bits) obtained as a result of each comparison as the conversion data. Furthermore, the mode may be switched, every selection period, between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period. Accordingly, the number of times the voltage to be applied to the signal electrode is switched is reduced.

The present invention is also implementable as a liquid crystal device including the above driving circuit. Specifically, the liquid crystal device is a liquid crystal device for causing pixels at the intersections of scanning electrodes and signal electrodes to perform gray-scale display based on pieces of gray-scale data, each piece being formed of a plurality of bits. The liquid crystal device can include a scanning-electrode driving circuit for selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. The device can further include a conversion-data output circuit for comparing, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputting conversion data in accordance with the comparison results. The device can additionally include a voltage applying circuit for applying, in the selection period, a first voltage to the signal electrode for a period of duration in accordance with the conversion data and applying a second voltage differing from the first voltage to the signal electrode for the remaining period. According to the liquid crystal device, the number of voltage levels (of a data signal) to be applied to the signal electrode is reduced, and the processing for generating the data signal is simplified.

A driving method for an electro-optical device according to the present invention can be a driving method for an electro-optical device for causing pixels at the intersections of scanning electrodes and signal electrodes to perform gray-scale display based on pieces of gray-scale data, each piece being formed of a plurality of bits. The driving method includes selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. The method can further include, in each selection period in which three of the scanning electrodes are selected, comparing the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and generating conversion data in accordance with the comparison results, and in the selection period, applying a first voltage to the signal electrode for a period of duration in accordance with the conversion data, and applying a second voltage differing from the first voltage to the signal electrode for the remaining period.

A driving circuit for an electro-optical device according to the present invention can be a driving circuit for an electro-optical device for causing pixels at the intersections of scanning electrodes and signal electrodes to perform gray-scale display based on pieces of gray-scale data, each piece being formed of a plurality of bits. The driving circuit may include a scanning-electrode driving circuit for selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. The circuit can also include a conversion-data output circuit for comparing, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputting conversion data in accordance with the comparison results, and a voltage applying circuit for applying, in the selection period, a first voltage to the signal electrode for a period of duration in accordance with the conversion data and applying a second voltage differing from the first voltage to the signal electrode for the remaining period.

An electro-optical device according to the present invention can be an electro-optical device for causing pixels at the intersections of scanning electrodes and signal electrodes to perform gray-scale display based on pieces of gray-scale data, each piece being formed of a plurality of bits. The electro-optical device can include a scanning-electrode driving circuit for selecting three of the scanning electrodes in accordance with a predetermined scanning pattern having three rows and n columns (n is an integer greater than or equal to 3) n times in a vertical scanning period, and, at each selection, applying selection voltages in accordance with three column elements of the scanning pattern, the column elements corresponding to the selection, to the three scanning electrodes, respectively. The device may further include a conversion-data output circuit for comparing, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputting conversion data in accordance with the comparison results, and a voltage applying circuit for applying, in the selection period, a first voltage to the signal electrode for a period of duration in accordance with the conversion data and applying a second voltage differing from the first voltage to the signal electrode for the remaining period.

An electronic apparatus according to the present invention can include the above-described liquid crystal device. Accordingly, the circuit size and the power consumption are reduced.

An electronic apparatus according to the present invention can include the above-described electro-optical device. Accordingly, the circuit size and the power consumption are reduced.

Possible types of such electronic apparatuses include, for example, cellular phones and digital still cameras.

BRIEF DESCRIPTION OF THE DRAWINGS

The invention will be described with reference to the accompanying drawings, wherein like numerals reference like elements, and wherein:

FIG. 9 includes diagrams showing the contents of PWM tables used by the PWM unit;

FIG. 19 shows an equation used to perform gray-scale display using an MLS driving method in the background art.

DETAILED DESCRIPTION OF PREFERRED EMBODIMENTS

With reference to the drawings, an embodiment of the present invention will be described. It should be understood that various changes and modifications can be made in the present invention within the spirit and scope of the present invention.

Figure 1:
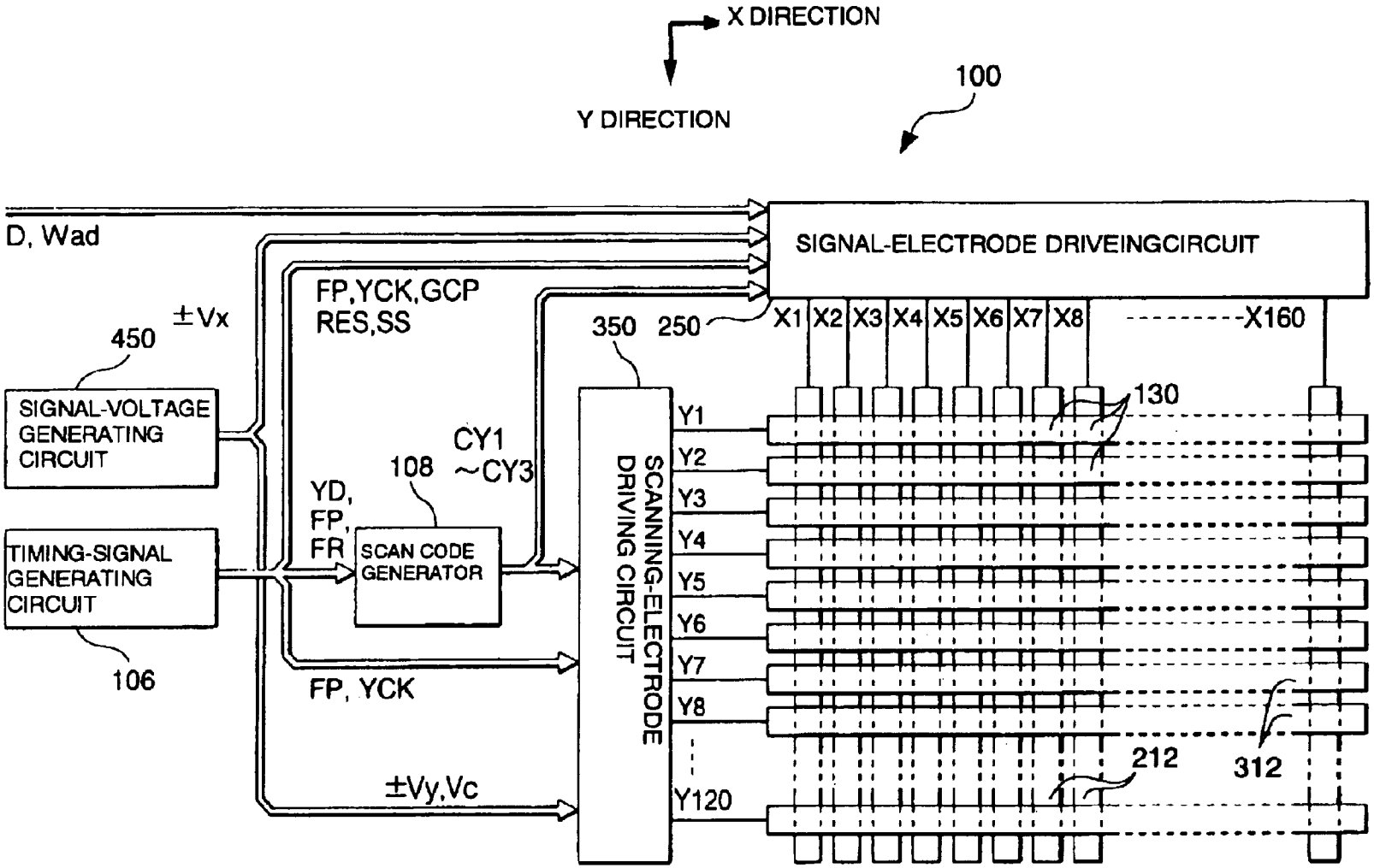
FIG. 1 is an exemplary block diagram showing the electrical configuration of a liquid crystal device according to an embodiment of the present invention.

FIG. 1 is an exemplary block diagram showing the electrical configuration of a liquid crystal device according to the embodiment of the present invention. As shown in the diagram, a liquid crystal device 100 includes a plurality of scanning electrodes (common electrodes) 312 extending in the row (X) direction and a plurality of signal electrodes (segment electrodes) 212 extending in the column (Y) direction. Each of the scanning electrodes 312 and the signal electrodes 212 is a strip electrode. Opposing portions of the scanning electrodes 312 and the signal electrodes 212 and liquid crystal, such as TN (Twisted Nematic) liquid crystal or STN (Super Twisted Nematic) liquid crystal, held therebetween form pixels 130. In the present embodiment, a case in which 120 scanning electrodes 312 and 160 signal electrodes 212 are provided is assumed. Thus, the resolution of the liquid crystal device 100 is 120 dots (vertical)×160 dots (horizontal). It should be understood that this is not intended to limit the liquid crystal device to which the present invention is applicable to this type of liquid crystal device.

A signal-voltage generating circuit 450 generates voltages applied to the scanning electrodes 312 and the signal electrodes 212 in order to drive the liquid crystal device 100. More specifically, the signal-voltage generating circuit 450 generates ±Vy (selection voltages) and Vc (non-selection voltage) used as voltages applied to the scanning electrodes 312 and supplies the generated voltages to a scanning-electrode driving circuit 350. Also, the signal-voltage generating circuit 450 generates ±Vx used as voltages applied to the signal electrodes 212 and supplies the generated voltages to a signal-electrode driving circuit 250. The voltage Vc is an intermediate voltage between the voltages +Vx and Vx used as data signals.

The scanning-electrode driving circuit 350 simultaneously selects a plurality of scanning electrodes 312 every horizontal scanning period and supplies scanning signals Y1, Y2, Y3, . . . , Y120 in accordance with the selection states to the corresponding scanning electrodes 312. In contrast, the signal-electrode driving circuit 250 supplies data signals X1, X2, X3, . . . , X160 in accordance with the contents displayed by pixels at the intersections of the scanning electrodes 312 selected by the scanning-electrode driving circuit 350 and each of the signal electrodes 250 to the corresponding signal electrodes 212. Details of the scanning-electrode driving circuit 350 and the signal-electrode driving circuit 250 will be described later.

The liquid crystal device 100 of the present embodiment can be driven by simultaneously selecting a plurality of scanning electrodes 312 and by selecting the scanning electrodes 312 multiple times in one vertical scanning period. In this driving method, the following scanning pattern is used when selection signals are applied to the scanning electrodes 312. Specifically, the scanning pattern is one type of matrix defining the polarity of a selection signal to be supplied to each of the simultaneously-selected scanning electrodes 312 every time the selection is performed. Rows of the scanning pattern correspond to the simultaneously-selected scanning electrodes 312, and columns correspond to the selections performed in one frame. Each element defines the polarity of a selection voltage.

For example, when the scanning pattern having M rows and N columns (M and N are integers greater than or equal to 2) is provided, the number of simultaneously-selected scanning electrodes is M, and selection is performed N times in one frame. An element at m-th row, n-th column (m is an integer that satisfies $1 \leqq m \leqq M$, and n is an integer that satisfies $1 \leqq n \leqq N$) defines the polarity of a selection voltage to be applied to the scanning electrode in m-th row of the simultaneously-selected scanning electrodes at n-th selection performed in one frame.

A condition required for the scanning pattern is that the scanning pattern should satisfy normality and orthogonality.

The "normality" refers to characteristics in which, when the scanning electrodes are selected and selection voltages are applied in accordance with the scanning pattern, the effective values of the selection voltages applied to the scanning electrodes are equal in frame units. The "orthogonality" refers to characteristics in which, when the scanning electrodes are selected and selection voltages are applied in accordance with the scanning pattern, the sum of products of the amplitude of a voltage applied to one of the scanning electrodes and the amplitude of a voltage applied to another arbitrary scanning electrode in one frame is zero.

Figure 2A:
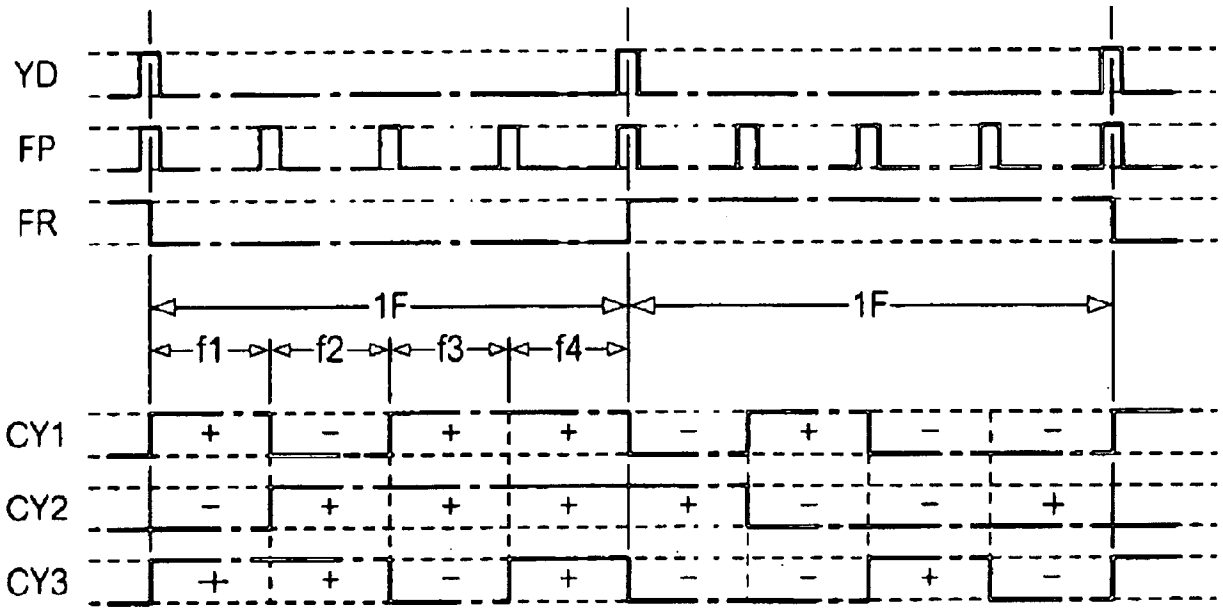
FIG. 2(*a*) is a timing chart showing the states in which scan codes generated by a scanning pattern generator of the liquid crystal device are output, and FIG. 2(*b*) illustrates the scanning pattern used by the liquid crystal device.
Figure 2B:
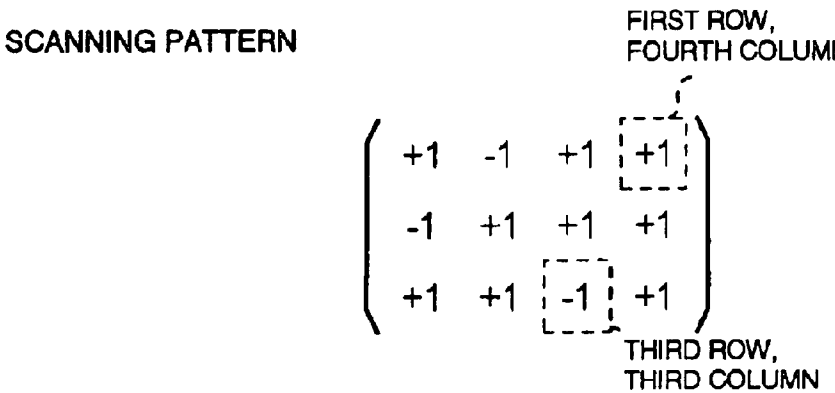

In the present embodiment, a three-row four-column scanning pattern shown in FIG. 2(*b*) is used to have "3" for the number of simultaneously-selected scanning electrodes. In the shown scanning pattern, for example, the element "+1" in the first row, fourth column indicates that the positive selection voltage should be applied to the first scanning electrode 312 of three simultaneously-selected scanning electrodes 312 at the fourth selection performed in one frame. For example, the element "1" in the third row, third column indicates that the negative selection voltage should be applied to the third scanning electrode 312 of the simultaneously-selected three scanning electrodes 312 at the third selection performed in one frame. It may be clear that the shown scanning pattern satisfies the above-described normality and orthogonality. (The polarity may not be on the basis of 0[V]. The positive and negative polarities mean that potentials are at the positive side and the negative side viewed from a reference potential.)

There are two selection methods for selecting the scanning electrodes 312: (1) selecting the scanning electrodes 312 in one frame in a temporally dispersed manner; and (2) selecting the scanning electrodes 312 in one frame in a temporally intensive manner. The method (1) described in the present embodiment, and the method (2) will be described in a modification described below.

In order to perform such driving, a timing-signal generating circuit 106 generates necessary control signals and clock signals. More specifically, the timing-signal generating circuit 106 generates a frame start pulse YD, a field start pulse FP, a frame signal Fr, a clock signal YCK, a gray-scale control signal GCP, a reset signal RES, and an odd-even signal SS. The signals will now be described schematically.

First, the frame start pulse YD is, as shown in FIG. 2(*a*), a pulse output at the beginning of a vertical scanning period (frame) 1F. Second, the field start pulse FP includes, as shown in FIG. 2(*a*), pulses output at the beginning of four equal fields f1, f2, f3, and f4 generated by equally dividing one frame (1F) into four fields.

Third, the frame signal FR is a signal whose level is inverted every frame (1F). Fourth, the clock signal YCK has a cycle of one horizontal scanning period (see FIG. 4).

Figure 10:
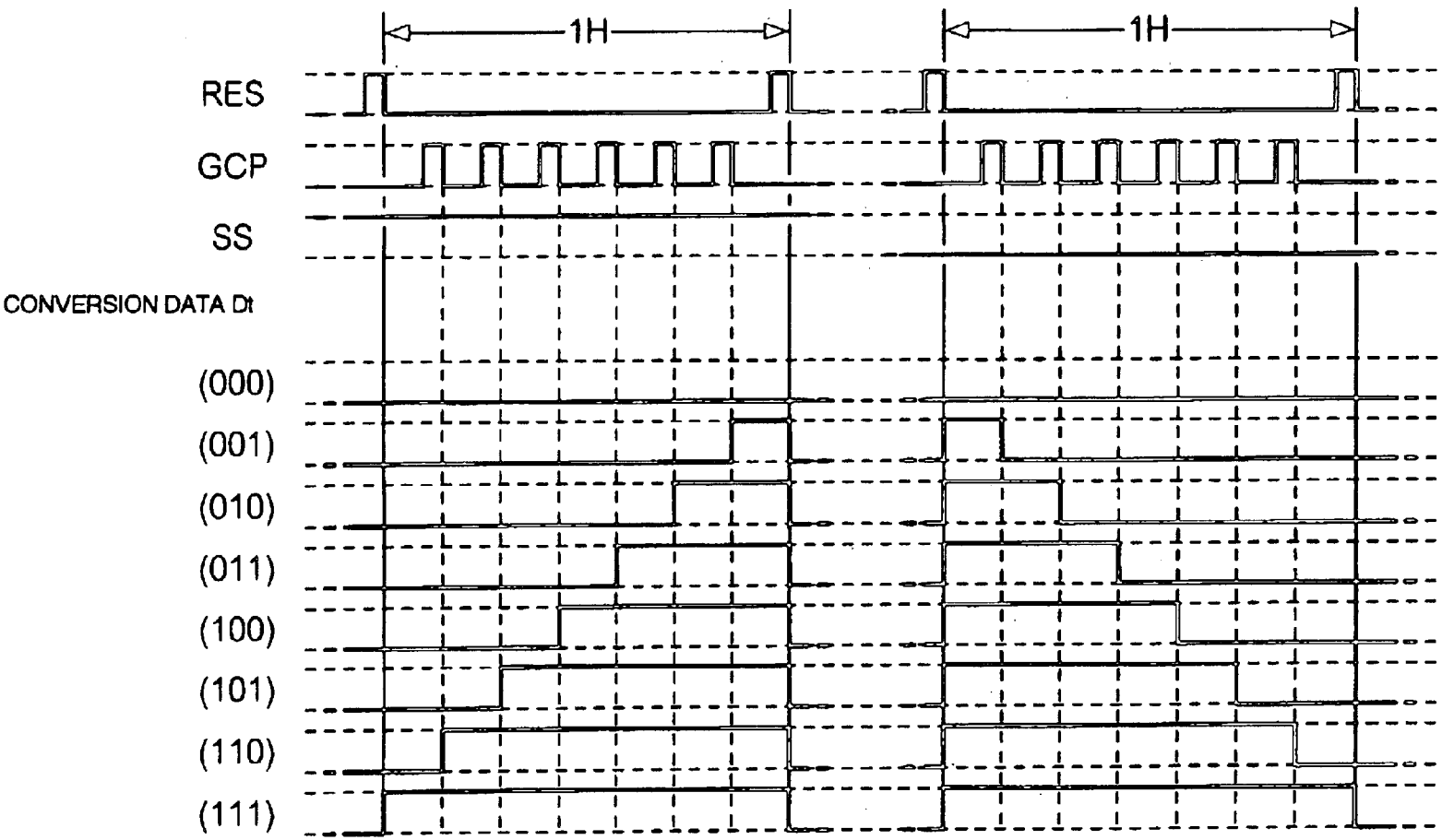
FIG. 10 is a timing chart for describing the operation of the PWM unit.

Fifth, the reset signal RES is, as shown in FIG. 10, a pulse that falls at the beginning of a horizontal scanning period (1H). Sixth, the gray-scale control signal GCP includes, as shown in FIG. 10, pulses arranged at points in accordance with halftone levels in a horizontal scanning period. In the present embodiment, gray-scale data D has 3 bits indicating a density of a pixel, and 8-level gray-scale display is performed. When the gray-scale data D is (000), white (off) is indicated, and, in contrast, (111) indicates black (on). In such a case, the gray-scale control signal GCP includes pulses corresponding to six gray levels (001) to (110), excluding white and black, arranged in accordance with halftone levels. In the present embodiment, the pulses of the gray-scale control signal GCP are arranged at equal pitches. In practice, it is preferable to compensate for non-linearity of voltage-transmissivity characteristics of the liquid crystal by having different pulse intervals in accordance with the characteristics.

Seventh, the odd-even signal SS is a signal whose level is inverted every horizontal scanning period.

Figure 14:
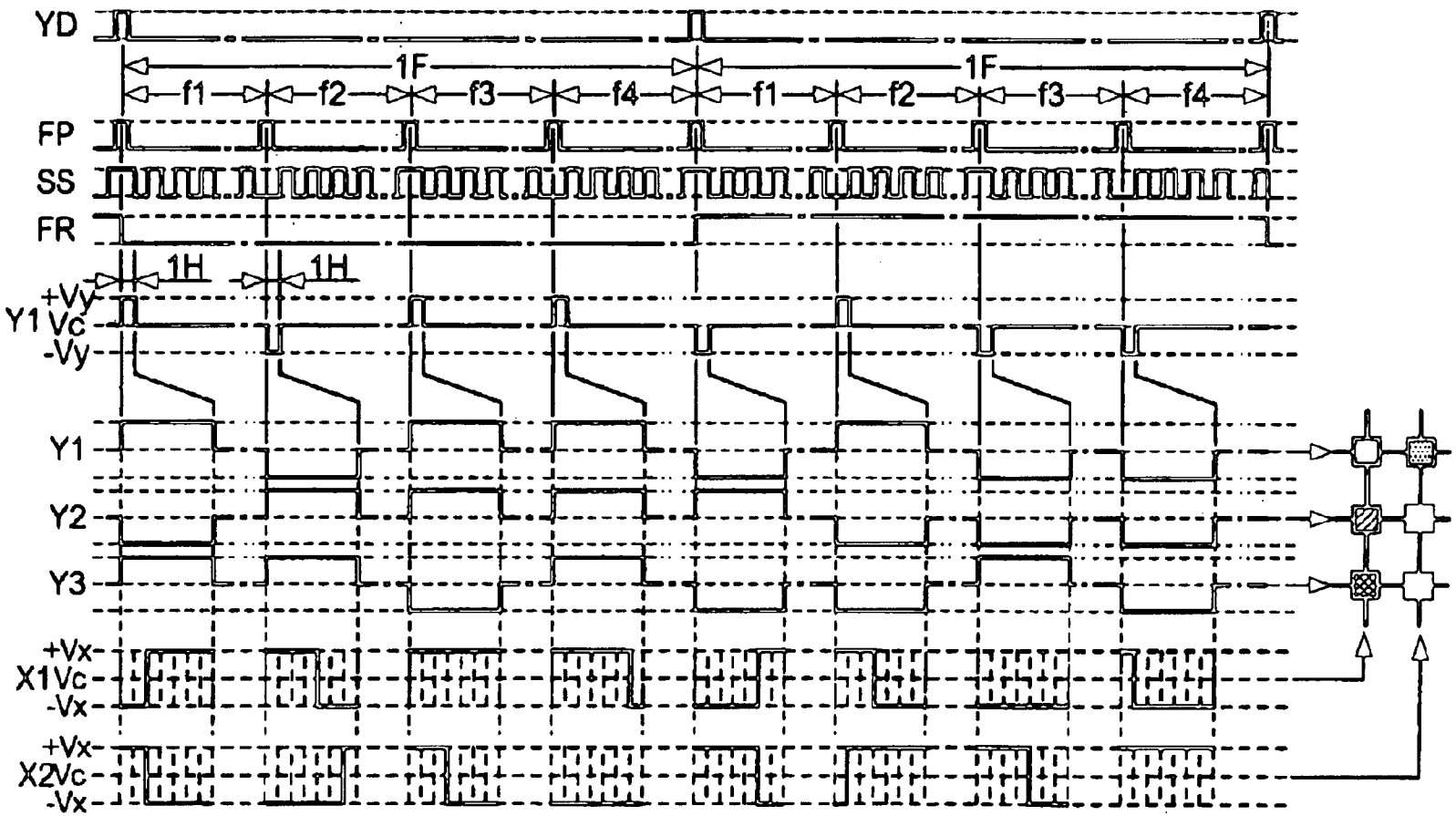
FIG. 14 is a timing chart for describing the operation of the liquid crystal device.

Specifically, the odd-even signal SS is, as shown in FIG. 14, at the H level in odd-numbered horizontal scanning periods (1H) and at the L level in even-numbered horizontal scanning periods (1H) in the fields f1 and f3 in one frame (1F). In contrast to the fields f1 and f3, in the fields f2 and f4 in one frame (1F), the odd-even signal SS is at the L level in odd-numbered horizontal scanning periods and at the H level in even-numbered horizontal scanning periods.

A scan code generator 108 shown in FIG. 1 outputs scan codes CY1, CY2, and CY3 shown in FIG. 2(*a*) based on the frame start pulse YD, the field start pulse FP, and the frame signal FR. The scan codes CY1, CY2, and CY3 are column elements of the scanning pattern and correspond to the fields f1, f2, f3, and f4 in time series. Specifically, for example, the scan code CY1 in a period in which the frame signal FR is at the L level corresponds to, as shown in FIG. 2(*a*), the first row, first column element, the first row, second column element, the first row, third column element, and the first row, fourth column element of the scanning pattern, which are output in the fields f1, f2, f3, and f4, respectively. Similarly, the scan codes CY2 and CY3 in the period in which the frame signal FR is at the L level correspond to the second row, first column to second row, fourth column elements and to the third row, first column to third row, fourth column elements, respectively, of the scanning pattern, which are output in the fields f1, f2, f3, and f4, respectively. In contrast, the scan codes CY1, CY2, and CY3 generated in a frame in which the frame signal FR is at the H level are, as shown in FIG. 2(*a*), polarity-inverted from those in the frame in which the frame signal FR is at the L level.

Figure 3:
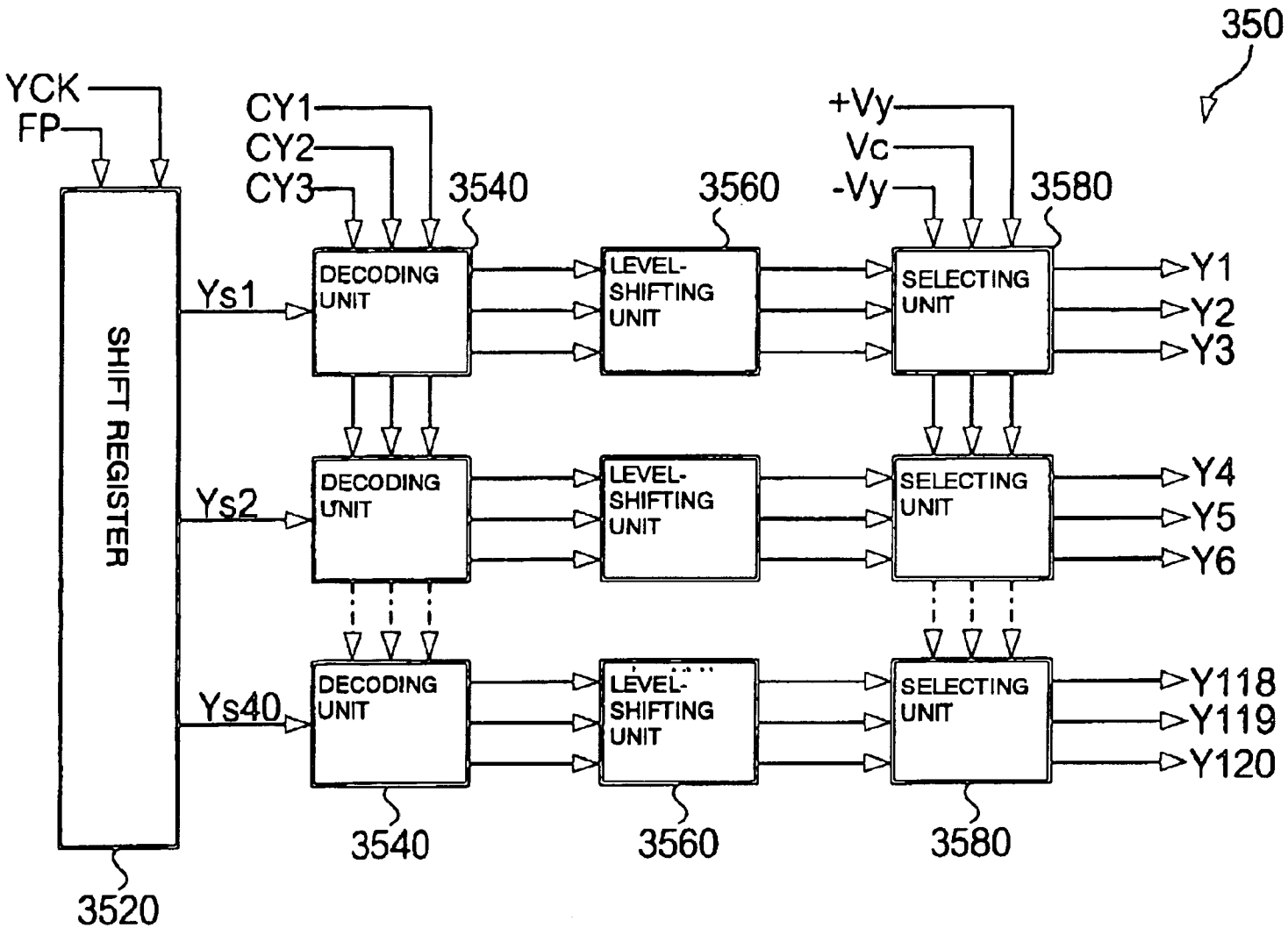
FIG. 3 is an exemplary block diagram showing the configuration of a scanning-electrode driving circuit in the liquid crystal device.
Figure 4:
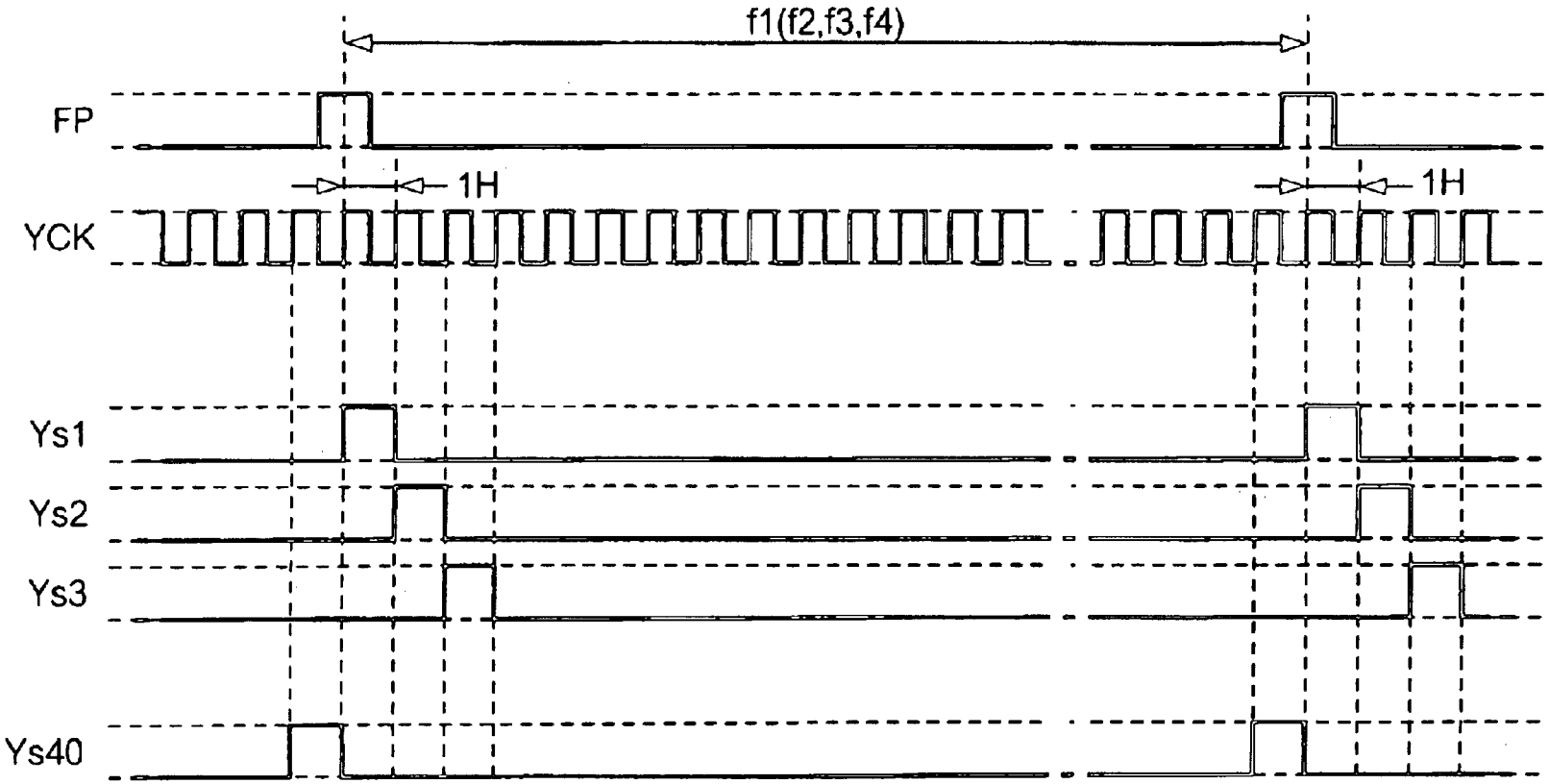
FIG. 4 is a timing chart for describing the operation of a shift register forming the scanning-electrode driving circuit.

The configuration of the scanning-electrode driving circuit 350 will now be described. FIG. 3 is an exemplary block diagram showing the configuration of the scanning-electrode driving circuit 350. In the diagram, a shift register 3520 is a 40-bit shift register corresponding to the number "40", which is obtained by dividing the number of scanning electrodes "120" by the number of simultaneously-selected electrodes "3". As shown in FIG. 4, the shift register 3520 shifts the above-described field start pulse FP every horizontal scanning period and sequentially outputs the shifted field start pulse FP as transfer signals Ys1 to Ys40. The transfer signal Ys1 designates the selection/non-selection of three scanning electrodes 312 in the first to third rows from the top in FIG. 1 (selected at the H level and not selected at the L level). Similarly, the transfer signal Ys2 designates the selection/non-selection of three scanning electrodes 312 in the fourth to sixth rows. The transfer signal Ys40 designates selection/non-selection of three scanning electrodes 312 in the 118-th to 120-th rows. Accordingly, for example, the scanning electrodes 312 in the first to third rows are simultaneously selected in the first horizontal scanning period in one frame, and the scanning electrodes 312 in the fourth to sixth rows are simultaneously selected in the next horizontal scanning period.

As shown in FIG. 3, decoding units 3540, level-shifting units 3560, and selecting units 3580, the number of each of which corresponds to the number of sets of simultaneously-selected three scanning electrodes 312 (40), are provided at a stage subsequent to the shift register 3250. Each decoding unit 3540 outputs voltage selection signals corresponding to the scanning electrodes 312 on the basis of the transfer signal supplied from the shift register 3250 and the scan codes CY1, CY2, and CY3 supplied from the scan code generator 108. The voltage selection signals designate which of the voltages +Vy, VC, and −Vy should be applied to three corresponding simultaneously-selected scanning electrodes 312. More specifically, each decoding unit 3540 outputs a voltage selection signal that designates the selection of the selection voltage +Vy or −Vy in accordance with the levels of the scan codes CY1, CY2, and CY3 in a period in which the transfer signal supplied from the shift register 3520 is at the H level (that is, in a horizontal scanning period in which the corresponding scanning electrodes 312 are selected). In contrast, each decoding unit 3540 outputs a voltage selection signal that designates the selection of the voltage Vc in a period in which the transfer signal is at the L level (that is, in a period in which the corresponding scanning electrodes 312 are not selected).

In contrast, each level-shifting unit 3560 expands the voltage amplitude of each of the voltage selection signals output from the corresponding decoding unit 3540 at the previous stage. Each selecting unit 3580 actually selects the selection voltages designated by the voltage selection signals, each of which has the expanded voltage amplitude, and applies the selection voltages to the corresponding scanning electrodes 312.

As described above, in the present embodiment, the driving method involving simultaneously selecting three scanning electrodes 312 and selecting the scanning electrodes 312 multiple times in one frame is adopted. In the driving method, in general, the voltage that should be applied to the signal electrode 212 in the j-th column (j is an integer that satisfies $1 \leqq j \leqq 160$) is determined as follows (a rough description thereof, instead of a detailed description, is given since the latter requires a mathematical proof). Specifically, the voltage that should be applied to the signal electrode 212 in the j-th column has a value obtained by multiplying column elements of the scanning pattern, the column elements corresponding to the selection, by corresponding elements of pixels located at the intersections of the signal electrode 212 in the j-th column and the simultaneously-selected scanning electrodes 312, obtaining the sum of the products (product-sum operation), and multiplying the sum by an appropriate coefficient.

Figure 5:
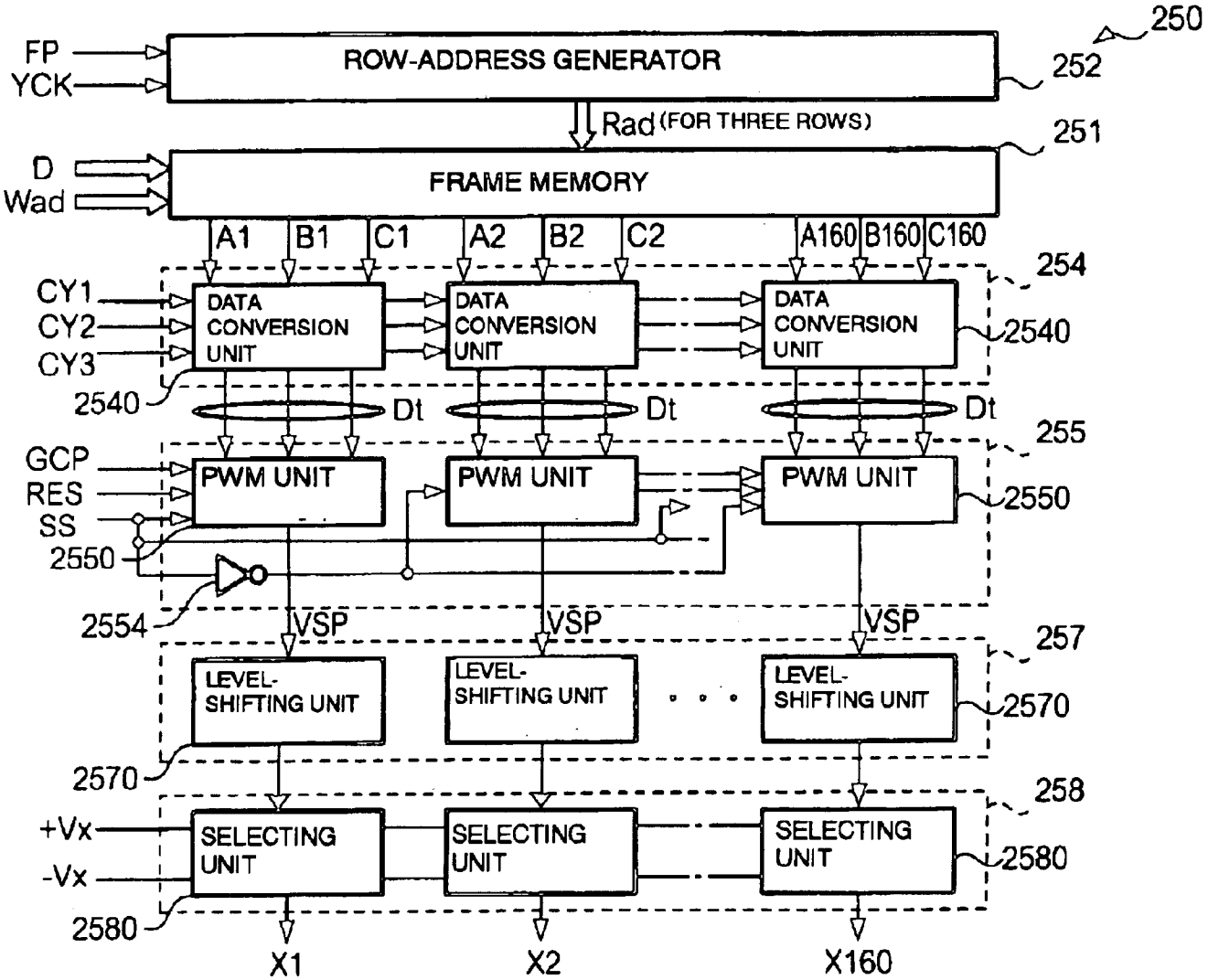
FIG. 5 is an exemplary block diagram showing the configuration of a signal-electrode driving circuit in the liquid crystal device.

In the present invention, pieces of gray-scale data D supplied to three pixels located at the intersections of simultaneously-selected scanning electrodes 312 and one arbitrary signal electrode 212 are compared with the scan codes CY1, CY2, and CY3. In accordance with the comparison results, conversion data Dt is generated. Using the conversion data Dt, PWM (pulse-width modulation) processing is performed, thus performing gray-scale display in accordance with the gray-scale data D. With reference to FIG. 5, the specific configuration of the signal-electrode driving circuit 250 will now be described.

As shown in FIG. 5, the signal-electrode driving circuit 250 can include a frame memory 251, a row-address generator 252, a conversion-data output circuit 254, a PWM circuit 255, a level-shifter group 257, and a selector group 258. Of the components, the frame memory 251 is a dual-port RAM having an area corresponding to 120-row×160-column pixels. In other words, at the write side of the frame memory 251, gray-scale data D supplied from a processing circuit (for example, a CPU), which is not shown, is written at a specified write address Wad. In contrast, at the read side of the frame memory 251, gray-scale data D is read from a row address Rad specified by the row-address generator 252.

The row-address generator 252 resets the row address Rad in response to the field start pulse FP supplied at the beginning of each of the fields f1, f2, f3, and f4 and advances the row address Rad by one step in response to the clock signal YCK having a cycle of one horizontal scanning period. More specifically, for example, in the first horizontal scanning period in one field, row addresses Rad for reading gray-scale data D for pixels belonging to three rows, namely, the first to third rows from the top in FIG. 1 ("3 rows×160 columns"), are generated. In the second horizontal scanning period, row addresses Rad for reading gray-scale data D for pixels belonging to three rows, namely, the fourth to sixth rows from the top in FIG. 1, are generated.

The read pieces of gray-scale data D for the pixels belonging to three rows are output via lines A1 to A160, B1 to B160, and C1 to C160, the number of each of which corresponds to the number of signal electrodes 212. Of the lines, the lines A1 to A160 are lines from which the gray-scale data D for 160 pixels belonging to the first row, of the read pieces of gray-scale data D for the three rows, are output. Similarly, the lines B1 to B160 and the lines C1 to C160 are lines from which the gray-scale data D for 160 pixels belonging to the second row and the third row, respectively, of the read pieces of gray-scale data D for the three rows, are output. This is generalized using an integer j ($1 \leqq j \leqq 160$) for specifying arbitrary one of the signal electrodes 212. Of the read pieces of gray-scale data D for the three rows, pieces of gray-scale data D for three pixels belonging to the j-th column are output to the lines Aj, Bj, and Cj.

Figure 6:
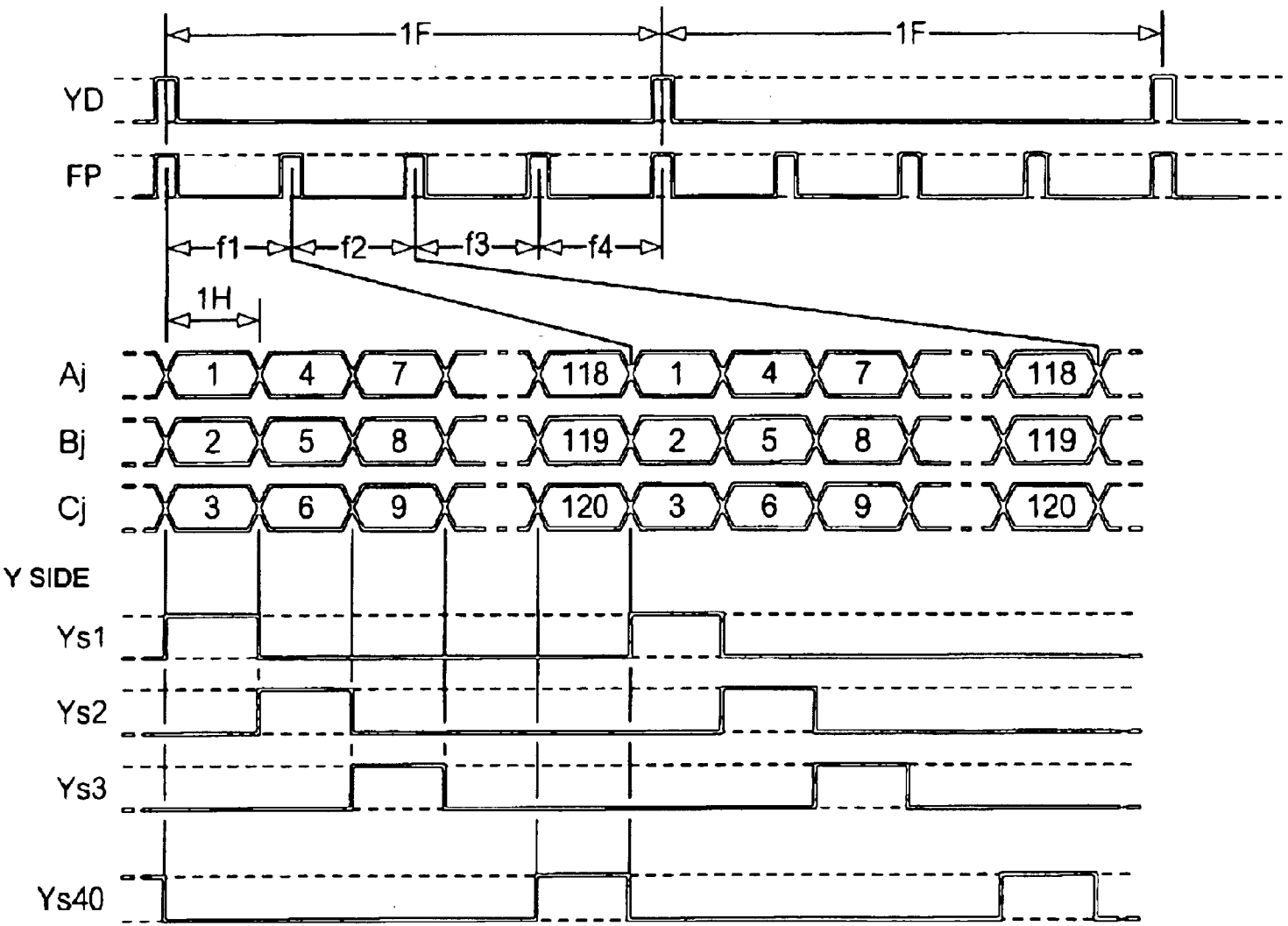
FIG. 6 is a timing chart for describing the operation of the signal-electrode driving circuit to read gray-scale data.

The row address Rad advances one step in response to the clock signal YCK having a cycle of one horizontal scanning period. As shown in FIG. 6, pieces of gray-scale data D for pixels belonging to the first, fourth, seventh, . .. , 118-th rows from the top in FIG. 1 are output via the lines A1 to A160 (generally denoted by Aj in FIG. 6) to the conversion-data output circuit 254 every horizontal scanning period forming one field. Similarly, as shown in FIG. 6, pieces of gray-scale data D for pixels belonging to the second, fifth, eighth, . . . , 119-th rows from the top in FIG. 1 are output via the lines B1 to B160 to the conversion-data output circuit 254 every horizontal scanning period. Also, pieces of gray-scale data D for pixels belonging to the third, sixth, ninth, . . . , 120-th rows from the top in FIG. 1 are output via the lines C1 to C160 to the conversion-data output circuit 254 every horizontal scanning period.

Figure 7:
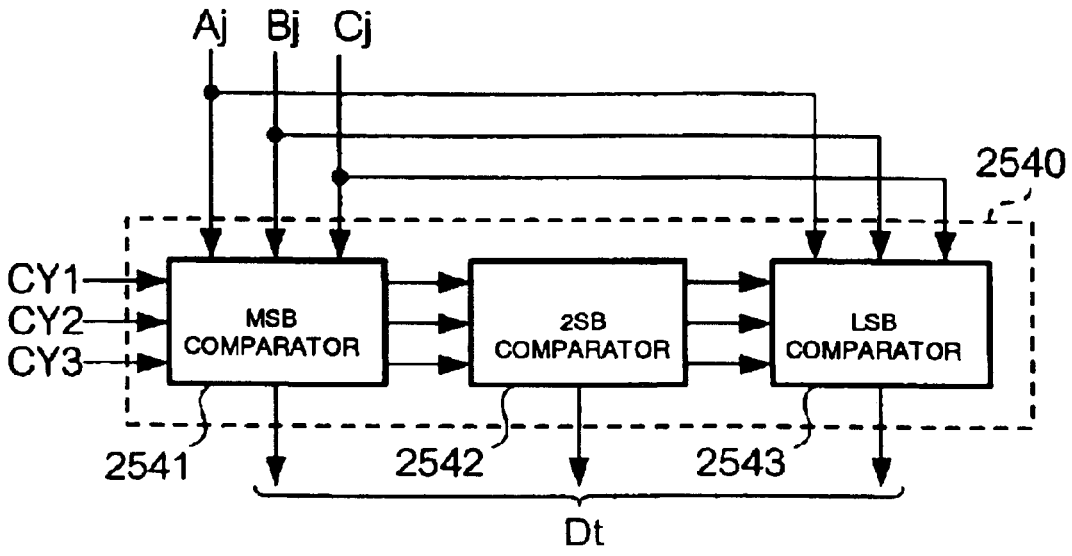
FIG. 7 is an exemplary block diagram showing the configuration of a data conversion unit forming the signal-electrode driving circuit.

In contrast, the conversion-data output circuit 254 has 160 data conversion units 2540, the number of which corresponds to the number of signal electrodes 212. Each data conversion unit 2540 compares pieces of gray-scale data D for three pixels, which are supplied from the frame memory 251, with the scan codes CY1, CY2, and CY3 supplied from the scan code generator 108 and outputs conversion data Dt in accordance with the comparison results. FIG. 7 is an exemplary block diagram showing the configuration of each data conversion unit 2540. As shown in the diagram, the data conversion unit 2540 can include an MSB comparator 2541, a 2SB comparator 2542, and an LSB comparator 2543.

The MSB comparator 2541 compares the most significant bits (MSBs) included in the pieces of gray-scale data D for three pixels, which are supplied from the frame memory 251, with bits corresponding to the levels of the scan codes CY1, CY2, and CY3, and, in accordance with the comparison results, outputs the bit (0) or (1) serving as the most significant bit of the conversion data Dt. Hereinafter the comparison method will now be described in detail.

The MSB comparator 2541 compares the bits of a bit string having the most significant bits included in the gray-scale data D for three pixels, which are supplied from the frame memory 251, with the corresponding bits of a bit string having bits corresponding to the levels of the scan codes CY1, CY2, and CY3 ((1) when the scan code is at the H level, and (0) when the scan code is at the L level), and counts the number of disagreeing bits (hereinafter referred to as "the number of non-conforming bits"). In other words, for example, pieces of gray-scale data for three pixels, which are supplied to one data conversion unit 2540, are denoted by Dn1 (MSB1, 2SB1, LSB1), Dn2 (MSB2, 2SB2, LSB2), and Dn3 (MSB3, 2SB3, LSB3). The MSB comparator 2541 compares the bits of a bit string having the most significant bits (MSB1, MSB2, MSB3) of the above gray-scale data with the bits of a bit string having three bits corresponding to the scan codes CY1, CY2, and CY3 and computes the number of non-conforming bits. When the number of non-conforming bits is "0" or "1", the MSB comparator 2541 outputs the bit (0) as the most significant bit of the conversion data Dt. When the number of non-conforming bits is "2" or "3", the MSB comparator 2541 outputs the bit (1) as the most significant bit of the conversion data Dt. In this case, the number of non-conforming bits is computed. Alternatively, the number of conforming bits can be computed. In other words, when the number of conforming bits is "0" or "1", the MSB comparator 2541 outputs the bit (1) as the most significant bit of the conversion data Dt. When the number of conforming bits is "2" or "3", the MSB comparator 2541 outputs the bit (0) as the most significant bit of the conversion data Dt.

Similarly, the 2SB comparator 2542 outputs the bit (1) or (0) as the second significant bit of the conversion data Dt in accordance with the number of non-conforming bits between a bit string having the second significant bits included in the pieces of gray-scale data for three pixels and the bit string corresponding to the levels of the scan codes CY1, CY2, and CY3. In the above-described case, the 2SB comparator 2542 outputs a bit in accordance with the number of non-conforming bits between a bit string having the second significant bits (S2B1, 2SB2, 2SB3) and the bit string corresponding to the scan codes. The LSB comparator 2543 outputs the bit (1) or (0) in accordance with the number of non-conforming bits between a bit string having the least significant bits (LSBs) included in the pieces of gray-scale data D for three pixels and the bit string corresponding to the levels of the scan codes CY1, CY2, and CY3. In the above-described case, the LSB comparator 2543 outputs a bit in accordance with the number of non-conforming bits between a bit string having the least significant bits (LSB1, LSB2, LSB3) and the bit string corresponding to the scan codes. A bit string having three bits output from the MSB comparator 2541, the 2SB comparator 2542, and the LSB comparator 2543 is output as the conversion data Dt to the PWM circuit 255.

As shown in FIG. 5, the PWM circuit 255 includes PWM units 2550 at 160 stages, the number of which corresponds to the number of signal electrodes 212, and an inverter 2554. Each PWM unit 2550 outputs a voltage selection signal VSP based on the conversion data Dt supplied from the corresponding data conversion unit 2540 at the previous stage. The voltage selection signal VSP designates which of the voltages +Vx or Vx should be applied to the signal electrode 212 for a duration corresponding to the contents of the conversion data Dt in a horizontal scanning period and designates application of the other voltage for the remaining duration. As shown in FIG. 5, the odd-even signal SS is input to odd-numbered (first, third, . . . , 159-th) PWM units 2550 of 160 PWM units 2550 forming the PWM circuit 255. In contrast, the inverted odd-even signal $\overline{SS}$, which is generated by inverting the level of the odd-even signal SS by the inverter 2554, is input to even-numbered (second, fourth, . . . , 160-th) PWM units 2550.

Figure 8:
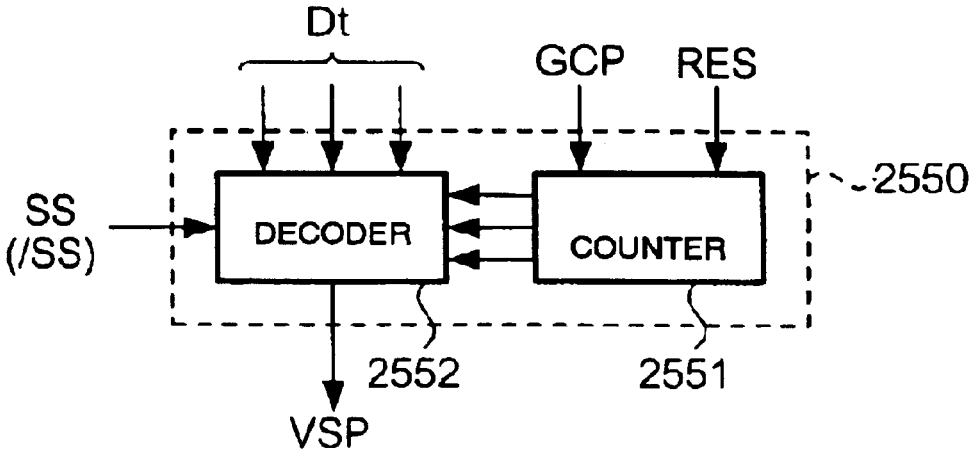
FIG. 8 is an exemplary block diagram showing the configuration of a PWM unit forming the signal-electrode driving circuit.

FIG. 8 is an exemplary block diagram showing the configuration of each PWM unit 2550. For example, the odd-numbered PWM unit 2550 to which the odd-even signal SS is input will now be described. As shown in the diagram, the PWM unit 2550 has a counter 2551 and a decoder 2552. Of the components, the counter 2551 is reset at the fall of the reset signal RES, that is, at the start of a horizontal scanning period, subsequently counts upward the number of times the gray-scale control signal GCP falls, and outputs the obtained count value (3 bits) to the decoder 2552. In contrast, the decoder 2552 outputs, in accordance with PWM tables shown in FIGS. 9(*a*) and (*b*) and the odd-even signal SS supplied from the timing-signal generating circuit 106, a voltage selection signal VSP corresponding to the contents of the conversion data Dt supplied from the data conversion unit 2540 and the count value output from the counter 2551. A detailed description is as follows.

More specifically, in a horizontal scanning period in which the odd-even signal SS is at the H level, the decoder 2552 outputs, in accordance with the PWM table shown in FIG. 9(*a*), as shown in FIG. 10, an L-level voltage selection signal VSP designating the selection of the voltage Vx for a duration from the start of the horizontal scanning period to a point at which the count value becomes a value corresponding to the conversion data Dt. In contrast, the decoder 2552 outputs an H-level voltage selection signal VSP designating the selection of the voltage +Vx for a duration from the point at which the count value becomes the value corresponding to the conversion data Dt to the end of the horizontal scanning period.

In contrast, in a horizontal scanning period in which the odd-even signal SS is at the L level, the decoder 2552 outputs, in accordance with the PWM table shown in FIG. 9(*b*), as shown in FIG. 10, an H-level voltage selection signal VSP designating the selection of the voltage +Vx for a duration from the start of the horizontal scanning period to a point at which the count value becomes a value corresponding to the conversion data Dt. In contrast, the decoder 2552 outputs an L-level voltage selection signal VSP designating the selection of the voltage −Vx for a duration from the point at which the count value becomes the value corresponding to the conversion data D to the end of the horizontal scanning period.

As is clear from the above description, the duration of a period in which the selection of the voltage +Vx (or −Vx) is designated corresponds to the contents of the conversion data Dt disregard of the level of the odd-even signal SS, that is, H level or L level. As discussed above, the odd-even signal SS switches the period in which the voltage −Vx should be selected between the period including the start of each horizontal scanning period and the period including the end of each horizontal scanning period. As shown in FIGS. 9 and 10, the PWM unit 2550 outputs an L-level voltage selection signal VSP designating the selection of the voltage −Vx for one horizontal scanning period when the conversion data Dt is (000) and outputs an H-level voltage selection signal VSP designating the selection of the voltage +Vx for one horizontal scanning period when the conversion data Dt is (111).

In the following description, in the first horizontal scanning period of each frame, the voltage of a data signal for turning on the pixel 130 at the intersection of the first-row scanning electrode 312 and the first-column signal electrode 212 is referred to as the "ON voltage". For example, the voltage −Vx of a data signal in the first frame shown in FIG. 11, that is, in a frame in which the frame signal FR is at the L level, corresponds to the "ON voltage". In contrast, since the selection voltages applied to the scanning electrodes 312 in the second frame subsequent to the first frame, that is, in a frame in which the frame signal is at the H level, have polarities opposite to those in the first frame, the voltage +Vx of a data signal in the second frame is the "ON voltage". In this specification, the starting portion of one horizontal scanning period is referred to as the "left", and the ending portion thereof is referred to as the "right". For example, when a period in which a data signal is at the ON voltage includes the start of a horizontal scanning period, that period is described as being "towards the left of the horizontal scanning period". When a period in which a data signal is at the ON voltage includes the end of a horizontal scanning period, that period is described as being "towards the right of the horizontal scanning period".

In this example, the odd-numbered PWM unit 2550 is illustrated. The even-numbered PWM unit 2550 has a similar function. As indicated by the parenthesis in FIG. 8, the inverted odd-even signal $\overline{SS}$ is input to the even-numbered PWM unit 2550. In a horizontal scanning period in which the odd-numbered PWM unit 2550 generates a voltage selection signal VSP that is at the H level in a period towards the left of the horizontal scanning period, the even-numbered PWM unit 2550 generates a voltage selection signal VSP that is at the H level in a period towards the right of the horizontal scanning period. Similarly, in a horizontal scanning period in which the odd-numbered PWM unit 2550 generates a voltage selection signal VSP that is at the H level in a period towards the right of the horizontal scanning period, the even-numbered PWM unit 2550 generates a voltage selection signal VSP that is at the H level in a period towards the left of the horizontal scanning period.

Referring back to FIG. 5, level-shifting units 2570 forming the level-shifter group 257 each expand the voltage amplitude of the voltage selection signal VSP output from the corresponding PWM unit 2550 and output the expanded voltage selection signal VSP. Selecting units 2580 forming the selector group 258 each select the voltage +Vx or −Vx in accordance with the level of the voltage selection signal VSP output from the corresponding level-shifting unit 2570 and apply the selection voltage to the signal electrode 212. More specifically, when the voltage selection signal VSP is at the H level, the selecting unit 2580 selects the voltage +Vx. When the voltage selection signal VSP is at the L level, the selecting unit 2580 selects the voltage −Vx. Therefore, the period in which a data signal is at the voltage +Vx is towards the right or the left of a horizontal scanning period in accordance with the contents of the voltage selection signal VSP.

The operation of the above-described liquid crystal device will now be described. In the following description, k-th horizontal scanning period (k is an integer that satisfies $1 \leqq k \leqq 40$) from the start of one field formed of horizontal scanning periods (1H) may be referred to as the horizontal scanning period hk.

In the field f1 of a frame in which the frame signal FR is at the L level, the scan code generator 108 outputs the scan codes CY1, CY2, and CY3 at the H, L, and H levels, respectively, in accordance with the first-column elements "+1", "−1", and "+1" of the scanning pattern (see FIGS. 2(*a*) and (*b*)).

Figure 11:
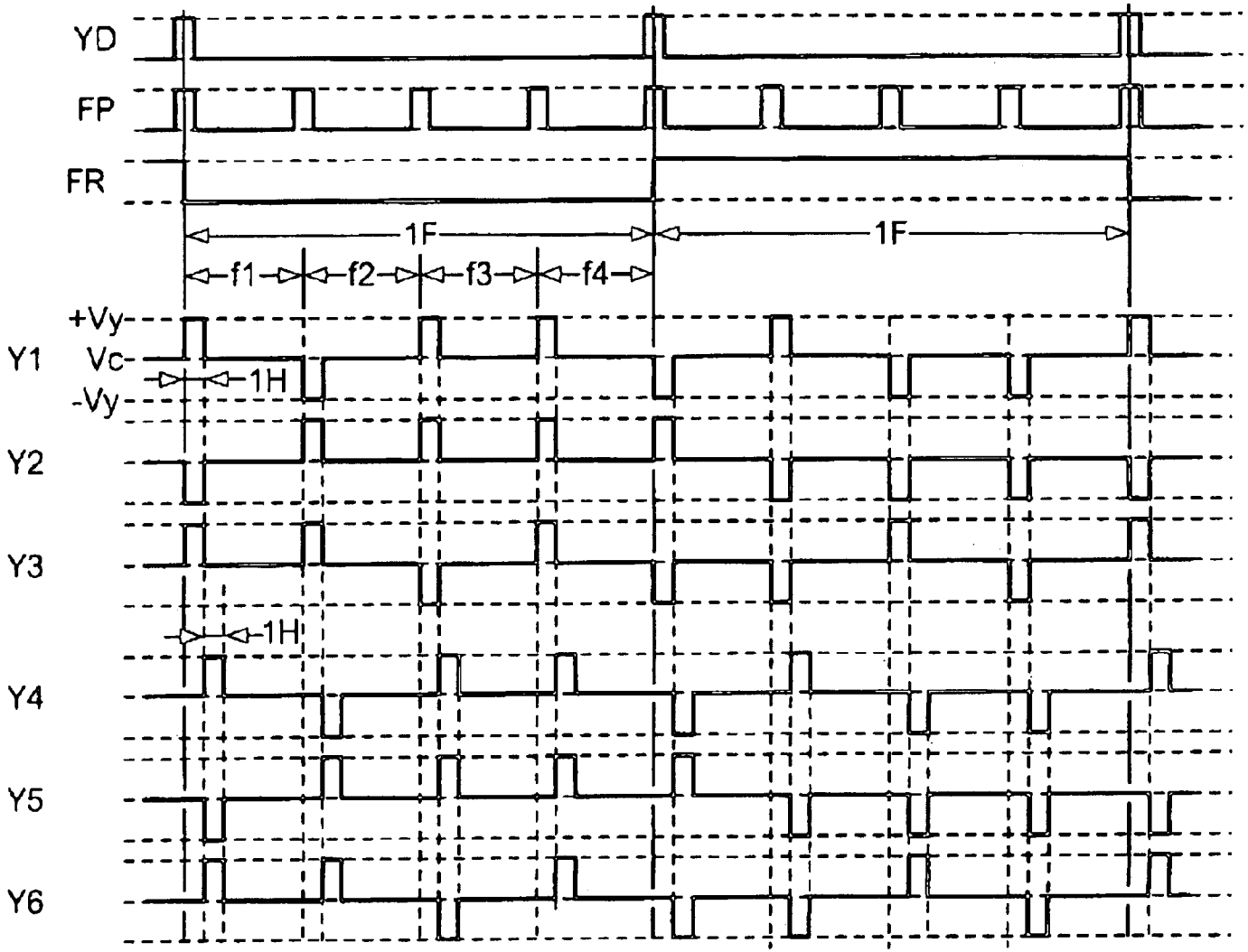
FIG. 11 is a timing chart for describing the operation of the scanning-electrode driving circuit in the liquid crystal device.

In contrast, when the field start pulse FP is supplied, as shown in FIG. 4, the shift register 3520 of the scanning-electrode driving circuit 350 sequentially latches the field start pulse FP at the rise of the clock signal YCK and outputs the latched field start pulse FP as transfer signals Ys1, Ys2, . . . , Ys40. For example, only the transfer signal Ys1 is at the H level in the first horizontal scanning period h1, and the selection of the scanning electrodes 312 in the first, second, and third rows is designated. In this case, the decoder 3540 corresponding to the scanning electrodes 312 in the first, second, and third rows outputs voltage selection signals designating which of the voltages +Vy and −Vy should be applied to the corresponding scanning electrodes 312 in accordance with the scan codes CY1, CY2, and CY3. In contrast, the decoders 3540 corresponding to the remaining scanning electrodes 312 (that is, the decoders 3540 to which the L-level transfer signals have been supplied) output voltage selection signals designating application of the voltage Vc to the scanning electrodes 312. As a result, as shown in FIGS. 11 and 14, scanning signals Y1, Y2, and Y3 in the first horizontal scanning period h1 in the field f1 are at the voltages +Vy, −Vy, and +Vy, respectively, and the other scanning signals are at the voltage Vc.

After one cycle of the clock signal YCK, the shift register 3520 causes only the transfer signal Ys2 to be at the H level in the second horizontal scanning period h2. Thus, the selection of the scanning electrodes 312 in the fourth, fifth, and sixth rows is designated. In this case, the decoder 3540 corresponding to the three selected scanning electrodes 312 outputs voltage selection signals designating which of the voltages +Vy and Vy should be applied to the scanning electrodes 312 in accordance with the scan codes CY1, CY2, and CY3. In contrast, the decoders 3540 corresponding to the remaining scanning electrodes 312 output voltage selection signals designating application of the voltage Vc to the scanning electrodes 312. As a result, as shown in FIGS. 11 and 14, scanning signals Y4, Y5, and Y6 in the second horizontal scanning period h2 in the field f1 are at the voltages +Vy, −Vy, and +Vy, respectively, and the other scanning signals are at the voltage Vc. Subsequently, similar operation is repeated in the field f1 up to the 40th horizontal scanning period h40.

In the field f2, the scan code generator 108 outputs the scan codes CY1, CY2, and CY3 at the L, H, and H levels, respectively, in accordance with the second-column elements "1", "+1", and "+1" of the scanning pattern (see FIGS. 2(*a*) and (*b*)). In the first horizontal scanning period h1 in which only the transfer signal Ys1 is at the H level, the scanning signals YS1, YS2, and YS3 are at the voltages −Vy, +Vy, and +Vy, respectively, and the other scanning signals are at the voltage Vc. In the second horizontal scanning period h2 in which only the transfer signal Ys2 is at the H level, the scanning signals Y4, Y5, and Y6 are at the voltages −Vy, +Vy, and +Vy, respectively, and the other scanning signals are at the voltage Vc. Subsequently, similar operation is repeated in the field f2 up to the 40th horizontal scanning period h40.

Similar processing is performed in the fields f3 and f4. That is, as shown in FIG. 11, in each of 40 horizontal scanning periods included in one field, each of scanning signals output to three scanning electrodes 312, the selection of which is designated by the H-level transfer signal, is either at the voltage +Vy or −Vy in accordance with the scan codes CY1, CY2, and CY3 in the field. On the other hand, scanning signals of the other scanning electrodes 312 are at the voltage Vc.

In the subsequent frame in which the frame signal FR is at the H level, the scan code generator 108 outputs, as the scan codes CY1, CY2, and CY3, signals of inverted polarity generated by inverting the polarity of the scan codes CY1, CY2, and CY3 in the period in which the frame signal FR is at the L level. Thus, as shown in FIG. 11, the scanning signals Y1, Y2, Y3, . . . , Y120 output in the period in which the frame signal FR is at the H level each have a polarity opposite to that of the corresponding scanning signal output in the period in which the frame signal FR is at the L level.

Voltage Waveform of Data Signal

Figure 12:
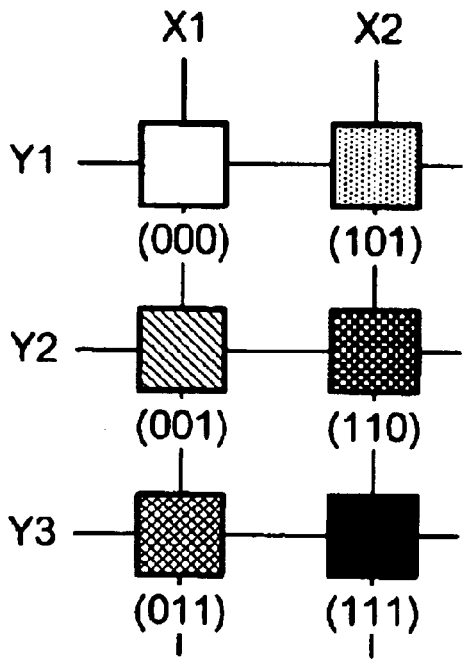
FIG. 12 illustrates the contents displayed by six pixels in order to describe the operation of the liquid crystal device.

The voltage waveforms of data signals X1, X2, X3, . . . , X160 output from the signal-electrode driving circuit 250 will now be described. In this description, as shown in FIG. 12, a case is described of six pixels located at the intersections of three scanning electrodes 312 in the first to third rows and two signal electrodes 212 in the first and second columns. A case in which gray-scale display is performed by the six pixels in accordance with gray-scale data D shown in the diagram is assumed.

The operation will now be described using a case of the first horizontal scanning period h1 of the field f1 in the frame in which the frame signal FR is at the L level. In the horizontal scanning period h1, pieces of gray-scale data D corresponding to the pixels in the first, second, and third rows are read from the frame memory 251. Of the read pieces of gray-scale data D for the three rows, pieces of gray-scale data D for pixels belonging to the j-th column are supplied via the lines Aj, Bj, and Cj to the data conversion unit 2540 at the j-th stage. For example, a case is described of pieces of gray-scale data D for the six pixels shown in FIG. 12. In this case, the pieces of gray scale data D (000), (001), and (011) corresponding to the first row, first column pixel, the second row, first column pixel, and the third row, first column pixel are supplied to the data conversion unit 2540 at the first stage. The pieces of gray-scale data D (101), (110), and (111) corresponding to the first row, second column pixel, the second row, second column pixel, and the third row, second column pixel are supplied to the data conversion unit 2540 at the second stage, and so forth.

Figure 13:
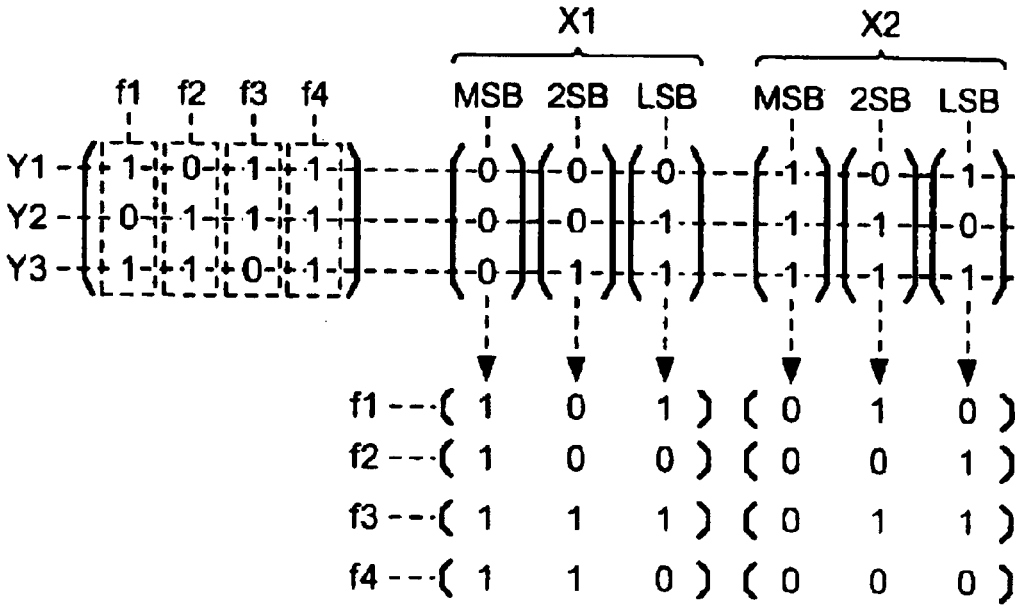
FIG. 13 illustrates the operation of a conversion data output circuit in the signal-electrode driving circuit.

In contrast, when the pieces of gray-scale data D for three pixels belonging to the same column are supplied, the MSB comparator 2541, the 2SB comparator 2542, and the LSB comparator 2543 forming the data conversion unit 2540 compare three bits in accordance with the levels of the scan codes CY1, CY2, and CY3 supplied from the scan code generator 108 with the most significant bits (MSBs), the second significant bits (2SBs), and the least significant bits (LSBs), respectively, included in the corresponding pieces of gray-scale data D and output bits in accordance with the comparison results as bits forming conversion data Dt. With reference to FIG. 13, a specific example of the operation of the data conversion unit 2540 will now be described. In this description, a case of the six pixels shown in FIG. 12 is described. Similar processing is performed for the other pixels belonging to three selected rows.

The operation of the first-stage data conversion unit 2540 to which the pieces of gray-scale data (000), (001), and (011) corresponding to the three pixels in the first row, first column, in the second row, first column, and in the third row, first column will now be described. In the field f1 of the frame in which the frame signal FR is at the L level, the scan codes CY1, CY2, and CY3 are at the H, L, and H levels, respectively. Thus, a bit string corresponding to the scan codes CY1, CY2, and CY3 is (101). The MSB comparator 2541 of the data conversion unit 2540 compares the bits of the bit string (101) with the corresponding bits of a bit string (000) having the most significant bits (MSBs) of the pieces of gray-scale data D for the three pixels. In this case, the number of non-conforming bits is "2". The MSB comparator 2541 thus outputs the bit (1) as the most significant bit of the conversion data Dt. At the same time, the 2SB comparator 2542 counts the number of non-conforming bits between the bit string (101) corresponding to the scan codes with a bit string (001) having the second significant bits (2SBs) of the pieces of gray-scale data D for the three pixels. In this case, the number of non-conforming bits is "1". The MSB comparator 2541 thus outputs the bit "0" as the second significant bit of the conversion data Dt. Similarly, the LSB comparator 2543 outputs the bit "1" as the least significant bit of the conversion data Dt in accordance with the number of non-conforming bits "2" between the bit string (101) corresponding to the scan codes and a bit string (011) having the least significant bits of the pieces of gray-scale data D for the three pixels. As a result, as shown in FIG. 13, the conversion data Dt(101) is obtained from the pieces of gray-scale data D for the three pixels and from the scan codes CY1, CY2, and CY3 in the field f1.

Similar processing is performed by the data conversion unit 2540 at the second stage, which has received the pieces of gray-scale data D (101), (110), and (111) corresponding to the three pixels in the first row, second column, in the second row, second column, and in the third row, second column. Specifically, in this case, the bit string (101) corresponding to the scan codes CY1, CY2, and CY3 is compared with each of a bit string (111) having the most significant bits, a bit string (011) having the second significant bits, and a bit string (101) having the least significant bits of the pieces of gray-scale data D for the three pixels. As a result, a bit string (010) in accordance with the number of non-conforming bits in each comparison, that is, "1", "2", and "0", is output as conversion data Dt.

When the pieces of conversion data Dt are supplied from the data conversion units 2540, the PWM units 2550 forming the PWM circuit 255 output voltage selection signals VSP, each of which designates the selection of the voltage +Vx or −Vx in accordance with the conversion data Dt in the horizontal scanning period h1. For example, the conversion data Dt(101) and the H-level odd-even signal SS are currently supplied to the PWM unit 2550 at the first stage. In this case, the PWM unit 2550 outputs, in accordance with the PWM table shown in FIG. 9(*a*), a voltage selection signal VSP that is at the L level designating the selection of the voltage −Vy in the first two periods of seven separate periods forming the horizontal scanning period h1 and at the H level designating the selection of the voltage +Vx in the remaining five periods. Subsequently, the selecting unit 2580 at the first stage selects the voltage +Vx or −Vx in accordance with the voltage selection signal VSP. As a result, the data signal X1 has the voltage waveform shown in FIG. 14. The voltage −Vx, which corresponds to the ON voltage in this case, is applied for a period towards the left of the horizontal scanning period h1.

In contrast, in the horizontal scanning period h1, the conversion data (010) and the L-level inverted odd-even signal $\overline{SS}$ are supplied to the PWM unit 2550 at the second stage. Thus, the PWM unit 2550 generates, in accordance with the PWM table shown in FIG. 9(*b*), a voltage selection signal VSP that is at the H level in the first two periods of seven separate periods forming the horizontal scanning period h1 and at the L level in the remaining five periods. As a result, the data signal X2 in the horizontal scanning period has the voltage waveform shown in FIG. 14. In this example, only the operation related to the data signals X1 and X2 has been described. Similar operation is performed with respect to the data signals X3 to X160. The period in which the data signal is at the ON voltage alternates between being towards the left and being towards the right of the horizontal scanning period h1 every signal electrode 212.

The operation in the second horizontal scanning period h2 in the field f1 will now be described. In the horizontal scanning period h2, as shown in FIG. 11, the scanning signals Y4, Y5, and Y6 are at the voltages +Vy, −Vy, and +Vy, respectively, and the other scanning signals are at the voltage Vc. In other words, three scanning electrodes 312 in the fourth to sixth rows in FIG. 1 are simultaneously selected.

A case is described of six pixels at the intersections of the three scanning electrodes 312 and the signal electrodes 212 in the first and second columns. A case in which pieces of gray-scale data D similar to those shown in FIG. 12 are supplied to the six pixels is assumed. In this case, the conversion data Dt supplied to each PWM unit 2550 in the horizontal scanning period h2 has contents similar to those supplied in the first horizontal scanning period h1. However, the level of the odd-even signal SS (and the inverted odd-even signal $\overline{SS}$) in the second horizontal scanning period h2 is inverted from that in the first horizontal scanning period h1. Thus, voltage selection signals VSP output from the odd-numbered PWM units 2550 are such that periods in which the voltage selection signals VSP are at the L level are towards the right of the horizontal scanning period h2 (see FIG. 15). On the other hand, voltage selection signals VSP output from the even-numbered PWM units 2550 are such that periods in which the voltage selection signals VSP are at the L level are towards the left of the horizontal scanning period h2.

Figure 15:
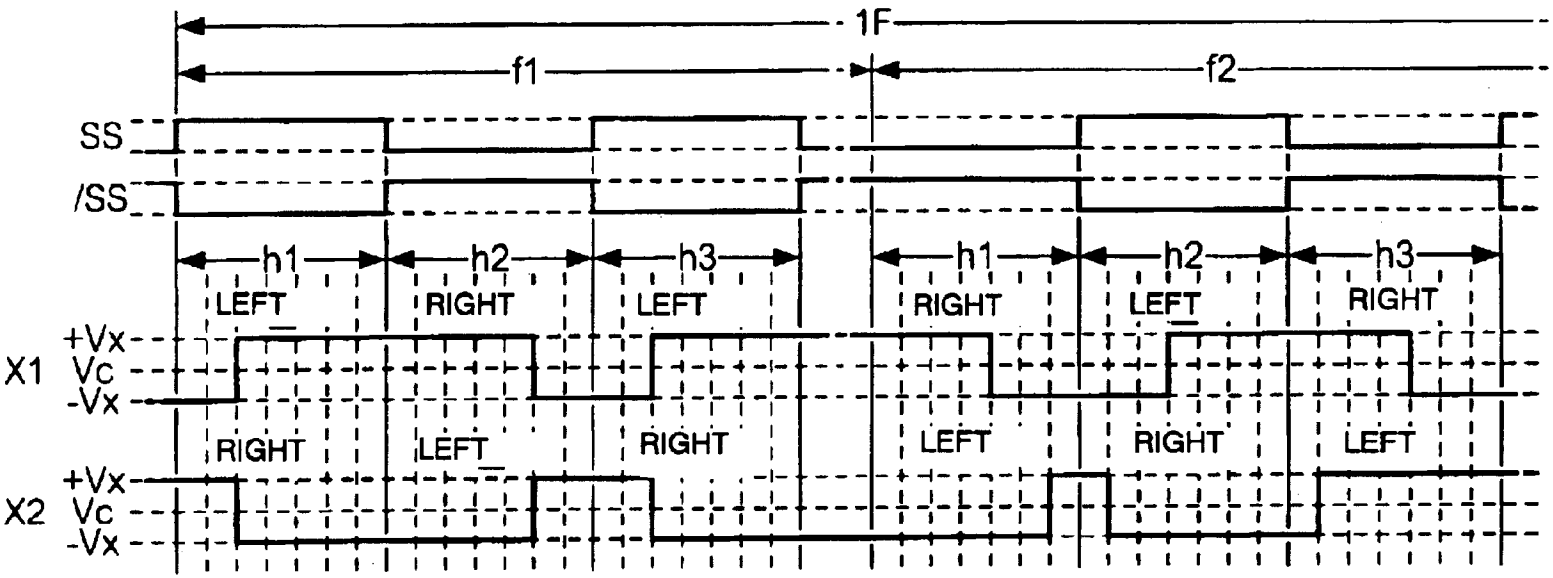
FIG. 15 is a timing chart for describing the operation of the liquid crystal device.

More specifically, the first-stage PWM unit 2550 (corresponding to the data signal X1), to which the conversion data Dt (101) and the L-level odd-even signal SS are supplied, outputs a voltage selection signal VSP that is at the H level in the first five periods of seven separate periods forming the horizontal scanning period h2 and that is at the L level in the remaining two periods in accordance with the PWM table shown in FIG. 9(*b*) (see FIG. 15). On the other hand, the second-stage PWM unit 2550 (corresponding to the data signal X2), to which the conversion data Dt(010) and the H-level inverted odd-even signal /SS are supplied, outputs a voltage selection signal VSP that is at the L level in the first five periods of seven separate periods forming the horizontal scanning period h2 and that is at the H level in the remaining two periods in accordance with the PWM table shown in FIG. 9(*a*). As a result, as shown in FIG. 15, the period in which the voltage of the data signal X1 is −Vx is towards the right of the horizontal scanning period h2, and the period in which the voltage of the data signal X2 is −Vx is towards the left of the horizontal scanning period h2. As discussed above, in the present embodiment, the period in which the voltage of the data signal is −Vx (or +Vx) alternates between being towards the left and being towards the right of a horizontal scanning period every horizontal scanning period.

The operation in the horizontal scanning periods h1 and h2 in the field f1 has been described. Similar operation is performed in the third horizontal scanning period h3 to the 40-th horizontal scanning period h40. In other words, in each horizontal scanning period, (1) pieces of gray-scale data D for pixels belonging to three rows are read from the frame memory 251; (2) bit strings, each of which consists of a bit in each position of the pieces of gray-scale data D, are each compared with a bit string in accordance with the levels of the scan codes CY1, CY2, and CY3, and conversion data Dt corresponding to the number of non-conforming bits based on each comparison result is generated; (3) a voltage selection signal VSP is generated in which a period in which the voltage selection signal VSP is at the H level in the horizontal scanning period is determined in accordance with the conversion data Dt; and (4) a data signal which is determined to be at the voltage +Vx or −Vx in accordance with the voltage selection signal VSP is supplied to the corresponding signal electrode 212.

Similar processing is performed in the fields f2, f3, and f4 subsequent to the field f1. As described above, the scan codes CY1, CY2, and CY3 change every field. Thus, conversion data Dt and data signals generated on the basis of the scan codes CY1, CY2, and CY3 differ from one field to another. For example, the levels of the scan codes CY1, CY2, and CY3 are at L, H, and H levels in the field f2 (see FIG. 2(*a*)). In the first horizontal scanning period h1 in the field f2, a bit string (011) corresponding to the scan codes CY1, CY2, and CY3 is compared with each of bit strings, each bit string consisting of a bit in each position of the same pieces of gray-scale data (for three pixels) as those read in the first horizontal scanning period h1. As a result, as shown in FIG. 13, conversion data Dt (100) is supplied to the PWM unit 2550 at the first stage, and conversion data Dt (001) is supplied to the PWM unit 2550 at the second stage in this horizontal scanning period.

When the conversion data Dt (100) is output in the field f2, the PWM unit 2550 at the first stage operates in accordance with the PWM table shown in FIG. 9(*b*). As a result, as shown in FIG. 14, the voltage of the data signal X1 is +Vx in the first four periods of seven separate periods forming the horizontal scanning period and −Vx in the remaining three periods. Similarly, when the conversion data Dt (001) is output to the PWM unit 2550 at the second stage, the voltage of the data signal X2 is −Vx in the first six periods of seven separate periods forming the horizontal scanning period and +Vx in the remaining one period.

The above-described operation is repeated in the fields f1 to f4. The effective values of voltages applied to the pixels in one frame are in accordance with the gray-scale data D. As a result, as shown in FIG. 14, gray-scale display performed by the pixels in accordance with the gray-scale data D is achieved.

As shown in FIG. 15, the odd-even signal SS is at the H level in the odd-numbered horizontal scanning periods (h1, h3 . . . , h39) and at the L level in the even-numbered horizontal scanning periods (h2, h4, . . . , h40) in the field f1 (and f3). In contrast, the odd-even signal SS is at the L-level in the odd-numbered horizontal scanning periods and at the H level in the even-numbered horizontal scanning periods in the fields f2 and f4. In the fields f2 and f4, the relationship between the fact that a horizontal scanning period is odd-numbered or even-numbered and the fact that the period in which a data signal is at the voltage −Vx is towards the left or the right of the horizontal scanning period is opposite from that in the fields f1 and f3. For example, a case of the data signal X1 is described. In each odd-numbered horizontal scanning period in the field f1 (and the field f3), the period in which the data signal X1 is at the voltage −Vx is towards the left of the horizontal scanning period. In each even-numbered horizontal scanning period, the period in which the data signal X1 is at the voltage −Vx is towards the right of the horizontal scanning period. In contrast, in each odd-numbered horizontal scanning period in the field f2 (and the field f4), the period in which the data signal X1 is at the voltage −Vx is towards the right of the horizontal scanning period. In each even-numbered horizontal scanning period, the period in which the data signal X1 is at the voltage −Vx is towards the left of the horizontal scanning period.

As described above, in the present embodiment, the number of non-conforming bits is counted between each of bit strings, each bit string consisting of a bit in each position of pieces of gray-scale data D corresponding to three pixels to be driven, and a bit string corresponding to the levels of scan codes CY1, CY2, and CY3, and conversion data Dt used by the corresponding PWM unit 2550 is generated on the basis of the number of non-conforming bits obtained in each comparison. In other words, according to the present embodiment, complicated calculation such as that shown in the background art is unnecessary. Accordingly, the circuit size can be reduced, and the processing speed can be enhanced.

A case of one signal electrode 212 is described. A data signal (and a voltage selection signal VSP) supplied to the signal electrode 212 alternates between being "towards the right" and "towards the left" every horizontal scanning period. Accordingly, performing halftone display does not require polarity change of the data signal. In other words, according to the present embodiment, the number of times the polarity of each data signal is changed is reduced, and the power consumption is thus reduced.

In the present embodiment, the relationship between the fact that a horizontal scanning period is odd-numbered or even-numbered and the fact that the period in which the data signal is at the ON voltage is towards the left or the right is switched every field and every frame. Display unevenness is thus prevented, and satisfactory display quality is maintained. Such advantages will now be described.

For example, a slight luminance difference occurs due to the influence of waveform rounding and polarity change of data signals when the absolute value of a voltage applied to the liquid crystal in a period including the start of a horizontal scanning period is greater than or less than the absolute value of a voltage applied to the liquid crystal in a period including the end of the horizontal scanning period. The result is thus recognized by an observer as display unevenness. In contrast, in the present embodiment, as shown in FIG. 14, "being towards the right" and "being towards the left" alternate every field (fields f1 to f4) and every frame. The absolute values of voltages applied to the liquid crystal in horizontal scanning periods are averaged, and a slight luminance difference that occurs is suppressed. As a result, display unevenness due to the luminance difference is suppressed.

Although the embodiment of the present invention has been described, the embodiment is for illustration purposes only. It should be understood that various modifications can be made in the embodiment without departing from the scope of the present invention. Possible modifications are described below.

Figure 16:
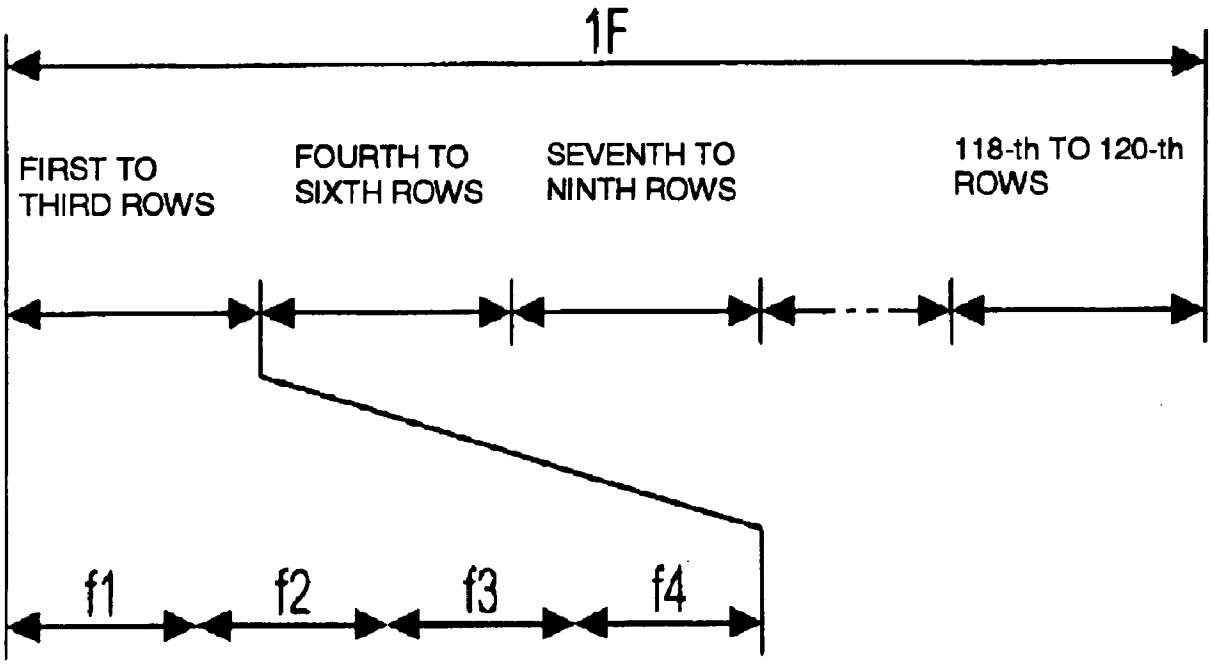
FIG. 16 is a timing chart showing the relationship between a frame and fields in a modification of the present invention.

In the above embodiment, one frame is equally divided into four fields f1 to f4, and the selection of scanning electrodes is temporally dispersed. However, the present invention is not only applicable to such type of liquid crystal device. For example, a non-dispersed driving method in which the selections are performed in a temporally intensive manner can be adopted. FIG. 16 is a timing chart showing the relationship between a frame and fields in the non-dispersed driving method. As shown in the diagram, the non-dispersed driving method involves changing scan codes CY1, CY2, and CY3 in a period in which three scanning electrodes 312 are selected. Thus, the period in which the three scanning electrodes 312 are selected includes the fields f1, f2, f3, and f4. For example, three scanning electrodes 312 in the first to third rows from the top in FIG. 1 are selected at the beginning of a frame. In each of the fields f1 to f4 forming the period in which the selection is performed, the levels of the scan codes CY1, CY2, and CY3 are changed in accordance with the scanning pattern. At the same time, in each of the fields f1 to f4, the signal-electrode driving circuit 250 performs a series of operations including reading of gray-scale data D, generation of conversion data Dt, generation of a voltage selection signal VSP, and application of a voltage to the signal electrode 212. As shown in FIG. 16, after the period in which the scanning electrodes 312 in the first to third rows are selected, the selection of scanning electrodes 312 in the fourth to sixth rows starts. Subsequently, similar operation is performed until scanning electrodes 312 in the 118-th to 120-th rows are selected. Finally, the processing in one frame is completed. In other words, the non-dispersed driving method involves intensive changing of the scan codes CY1, CY2, and CY3 when three scanning electrodes 312 are selected.

In the above embodiment, a case in which the relationship between the fact that a horizontal scanning period is odd-numbered or even-numbered and the fact that the period in which the data signal is at the ON voltage is towards the right or the left is switched every frame has been described. Alternatively, switching can be performed every two or more frames. For example, the relationship between the fact that a horizontal scanning period is odd-numbered or even-numbered and the fact that the period in which the data signal is at the ON voltage is towards the right or the left is the same in the first and second frames (in the fifth and sixth frames, . . . ). On the other hand, this relationship is switched in the third and fourth frames (in the seventh and eighth frames, . . . ). As discussed above, switching between being "towards the right" and "towards the left" every two frames allows a period in which a selection voltage is positive to include a period in which the data signal is towards the right or the left. At the same time, this type of switching allows a period in which the selection voltage is negative to include the period in which the data signal is towards the right or the left. As a result, display unevenness is further reduced.

In the above embodiment, a case in which the data signal is switched between being towards the left and being towards the right every signal electrode 212 has been described. Alternatively, the data signals may be switched every two or more of the signal electrodes 212. For example, one state in which the data signals supplied to the signal electrodes 212 in the first and second columns (two signal electrodes 212 in the fifth and sixth columns, . . . ) are towards the left or the right can be opposite to another state in which the data signals supplied to the signal electrodes 212 in the third and fourth columns (two signal electrodes 212 in the seventh and eighth columns, . . . ) are towards the left or the right. Alternatively, the data signals are switched between being towards the right and being towards the left every ten signal electrodes 212. As discussed above, the number of signal electrodes 212, which serves as the unit of switching between being towards the right and being towards the left, is arbitrary. In view of reducing display unevenness, it is preferable that the number of signal electrodes 212 in which the data signals are toward the right be the same as the number of signal electrodes 212 in which the data signals are towards the left.

In the above embodiment, a case in which the TN liquid crystal or STN liquid crystal is used has been described. Alternatively, bistable liquid crystal such as BTN (Bistable Twisted Nematic) liquid crystal or ferroelectric liquid crystal having a memory function, macromolecular dispersed liquid crystal, or guest-host liquid crystal can be used. In the guest-host liquid crystal, a dye (guest) which exhibits anisotropy in visible light absorption between the long axis direction and the short axis direction of the molecules is dissolved in liquid crystal (host) whose molecules are aligned in a certain direction, the dye molecules being oriented parallel to the liquid crystal molecules. Alternatively, a homeotropic alignment structure can be used. In the homeotropic alignment structure, with no voltage applied, the liquid crystal molecules are oriented perpendicular to both substrates, and, when a voltage is applied, the liquid crystal molecules are oriented parallel to both substrates. Alternatively, a homogeneous alignment structure can be used. In the homogeneous alignment structure, with no voltage applied, the liquid crystal molecules are oriented parallel to both substrates, and, when a voltage is applied, the liquid crystal molecules are oriented perpendicular to both substrates. As discussed above, various types of liquid crystal and various types of alignments can be used if they are in conformity with the driving method of the present invention. It should be understood that the present invention is applicable to transmissive liquid crystal devices, reflective liquid crystal devices, and transflective liquid crystal devices.

Electronic apparatuses using the liquid crystal device according to the present invention will now be described.

Figure 17:
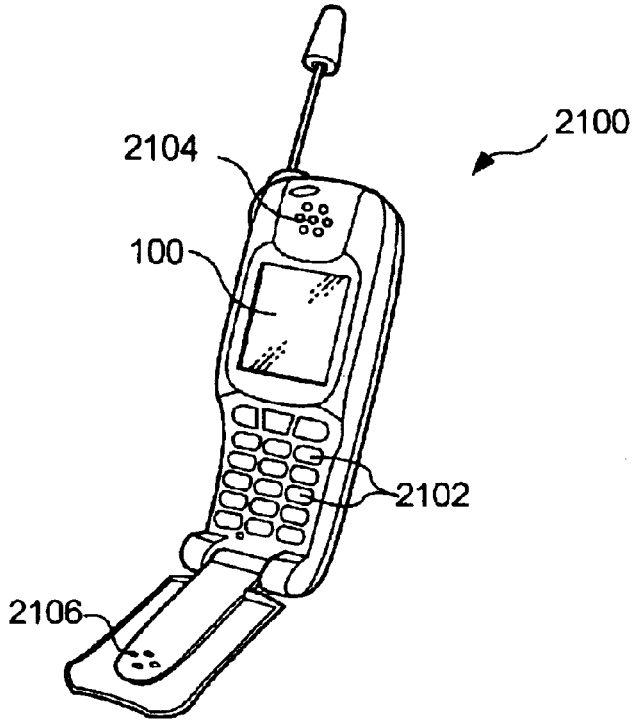
FIG. 17 is a perspective view showing the configuration of a cellular phone, which is an example of an electronic apparatus to which the liquid crystal device according to the present invention is applied.

A case in which the liquid crystal device according to the present invention is applied to a display unit of a cellular phone will now be described. FIG. 17 is a perspective view showing the configuration of the cellular phone. As shown in the drawing, a cellular phone 2100 includes a plurality of operation buttons 2102, a mouthpiece 2104, an earpiece 2106, and the above-described liquid crystal device 100.

Figure 18:
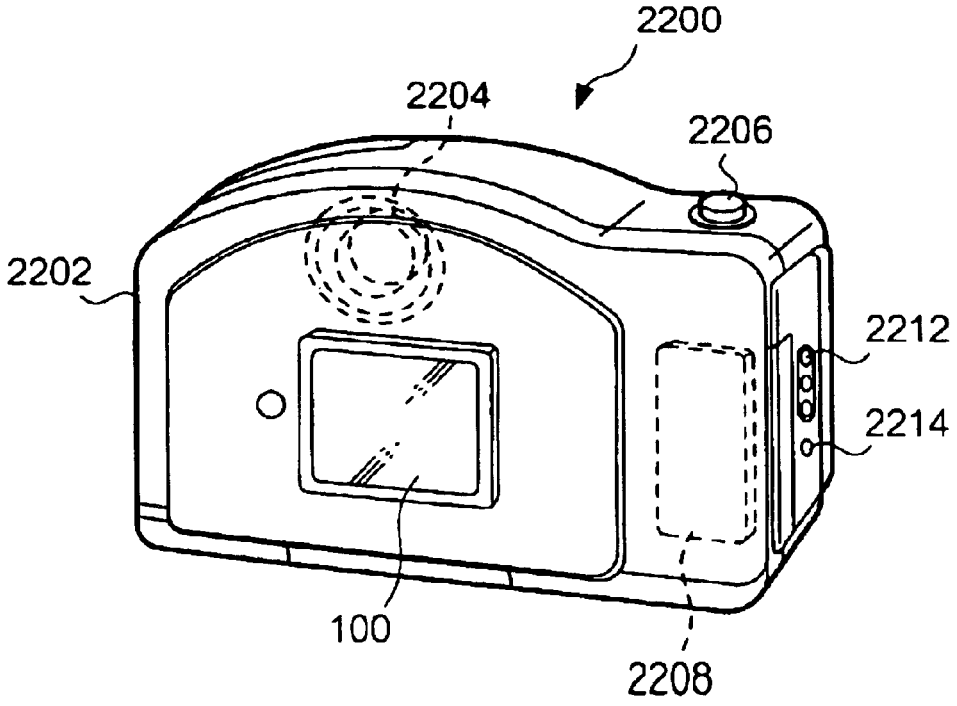
FIG. 18 is a perspective view showing the configuration of a digital still camera, which is an example of an electronic apparatus to which the liquid crystal device according to the present invention is applied.

A digital still camera having a finder formed of the above-described liquid crystal device 100 will now be described. FIG. 18 is a perspective view showing the rear surface of the digital still camera. Whereas a general silver-film camera exposes a film to light using an optical image of a subject, a digital still camera 2200 uses an image pickup device such as a CCD (Charge Coupled Device) to perform photoelectric conversion of an optical image of a subject and generates an image pickup signal.

The above-described liquid crystal device 100 is provided on the back of a case 2202 of the digital still camera 2200. The liquid crystal device 100 displays an image based on the image pickup signal generated by the CCD. Thus, the liquid crystal device 100 functions as the finder for displaying the subject.

A light receiving unit 2204 including an optical lens and the CCD is provided on the front side of the case 2202 (the back side in FIG. 18). When a user who wants to take a photograph confirms an image of the subject displayed on the liquid crystal device 100 and presses a shutter button 2206, an image pickup signal generated by the CCD at that time is transferred and stored in a memory of a circuit board 2208. In the digital still camera 2200, a video signal output terminal 2212 for external display and an input/output terminal 2214 for data communications are provided on the lateral side of the case 2202.

In addition to the cellular phone shown in FIG. 17 and the digital still camera shown in FIG. 18, the possible electronic apparatuses include a television, a viewfinder or monitor-direct-viewing video cassette recorder, a car navigation apparatus, a pager, an electronic notebook, an electronic calculator, a word processor, a workstation, a video phone, a POS terminal, and a device with a touch panel. Needless to say, the liquid crystal device according to the present invention is applicable to display units of these various electronic apparatuses.

Although an electro-optical device has been described as the liquid crystal device in the above description, the present invention is not limited to this. The present invention is also applicable to electrophoresis devices, electroluminescence (EL) devices, digital micromirror devices (DMD), electro-optical devices using various electro-optical elements using fluorescence by plasma emission or electronic emission, and electronic apparatuses having the electro-optical devices.

As described above, according to the present invention, the number of voltage levels of each data signal is reduced, and the processing for generating each data signal is simplified. In addition, the power consumption is reduced, and display quality is improved.

What is claimed is:

1. A driving method for a liquid crystal device that causes pixels at intersections of scanning electrodes and signal electrodes to perform gray-scale display based on pieces of gray-scale data, each piece being formed of a plurality of bits, comprising:

selecting three of the scanning electrodes in accordance with a predetermined scanning pattern having three rows and n columns (n is an integer greater than or equal to 3) n times in a vertical scanning period;

at each selection, applying selection voltages in accordance with three column elements of the scanning pattern, the column elements corresponding to the selection, to the three scanning electrodes, respectively;

in each selection period in which three of the scanning electrodes are selected, comparing bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and generating conversion data in accordance with comparison results; and in the selection period, applying a first voltage to the signal electrode for a period of duration in accordance with the conversion data, and applying a second voltage differing from the first voltage to the signal electrode for a remaining period.

2. The driving method for a liquid crystal device according to claim 1, wherein, in each selection period in which three of the scanning electrodes are selected, the bit string in accordance with the column elements of the scanning pattern, the column elements corresponding to the selection, is compared with each of the bit strings, each bit string being formed of a bit in each position of the pieces of gray-scale data for the three pixels at the intersections of the signal electrode and the three scanning electrodes, and a bit string comprising bits corresponding to at least one of a number of non-conforming bits the number of conforming bits obtained as a result of each comparison is used as the conversion data.

3. The driving method for a liquid crystal device according to claim 1, wherein a mode is switched, every selection period in which three of the scanning electrodes are selected, between one state in which a first-voltage application period is in a vicinity of a start of the selection period and a second-voltage application period is in the vicinity of an end of the selection period and another state in which the second-voltage application period is in the vicinity of the start of the selection period and the first-voltage application period is in the vicinity of the end of the selection period.

4. The driving method for a liquid crystal device according to claim 3, wherein a mode is switched, in each of the n selections of three scanning electrodes, between one state in which a first-voltage application period is in a vicinity of a start of the selection period and a second-voltage application period is in a vicinity of an end of the selection period and another state in which the second-voltage application period is in the vicinity of the start of the selection period and the first-voltage application period is in the vicinity of the end of the selection period.

5. The driving method for a liquid crystal device according to claim 3, wherein the mode is switched, every one or more of the vertical scanning periods, between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period.

6. The driving method for a liquid crystal device according to claim 3, wherein the mode is switched, every one or more of the signal electrodes, between one state in which the first-voltage application period is in the vicinity of the start of the selection period and the second-voltage application period is in the vicinity of the end of the selection period and another state in which the second-voltage application period is in the vicinity of the start of the selection period and the first-voltage application period is in the vicinity of the end of the selection period.

7. A driving circuit for a liquid crystal device for causing pixels at the intersections of scanning electrodes and signal electrodes to perform gray-scale display based on pieces of gray-scale data, each piece being formed of a plurality of bits, comprising:

a scanning-electrode driving circuit that selects three of the scanning electrodes in accordance with a predetermined scanning pattern having three rows and n columns (n is an integer greater than or equal to 3) n times in a vertical scanning period, and, at each selection, applies selection voltages in accordance with three column elements of the scanning pattern, the column elements corresponding to the selection, to the three scanning electrodes, respectively;

a conversion-data output circuit that compares, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputs conversion data in accordance with the comparison results; and a voltage applying circuit that applies, in the selection period, a first voltage to the signal electrode for a period of duration in accordance with the conversion data and applies a second voltage differing from the first voltage to the signal electrode for the remaining period.

8. The driving circuit for a liquid crystal device according to claim 7, wherein, in each selection period in which three of the scanning electrodes are selected, the conversion-data output circuit compares the bit string in accordance with the column elements of the scanning pattern, the column elements corresponding to the selection, with each of the bit strings, each bit string being formed of a bit in each position of the pieces of gray-scale data for the three pixels at the intersections of the signal electrode and the three scanning electrodes, and outputs a bit string comprising bits corresponding to a number of non-conforming bits (or a number of conforming bits) obtained as a result of each comparison as conversion data.

9. The driving circuit for a liquid crystal device according to claim 7, wherein the mode is switched, every selection period, between one state in which a first-voltage application period is in a vicinity of a start of the selection period and a second-voltage application period is in a vicinity of a end of the selection period and another state in which the second-voltage application period is in the vicinity of the start of the selection period and the first-voltage application period is in the vicinity of the end of the selection period.

10. A liquid crystal device for causing pixels at the intersections of scanning electrodes and signal electrodes to perform gray-scale display based on pieces of gray-scale data, each piece being formed of a plurality of bits, comprising:

a scanning-electrode driving circuit that selects three of the scanning electrodes in accordance with a predetermined scanning pattern having three rows and n columns (n is an integer greater than or equal to 3) n times in a vertical scanning period, and, at each selection, applies selection voltages in accordance with three column elements of the scanning pattern, the column elements corresponding to the selection, to the three scanning electrodes, respectively;

a conversion-data output circuit that compares, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputting conversion data in accordance with the comparison results; and a voltage applying circuit that applies, in the selection period, a first voltage to the signal electrode for a period of duration in accordance with the conversion data and applying a second voltage differing from the first voltage to the signal electrode for a remaining period.

11. A driving method for an electro-optical device for causing pixels at the intersections of scanning electrodes and signal electrodes to perform gray-scale display based on pieces of gray-scale data, each piece being formed of a plurality of bits, comprising:

selecting three of the scanning electrodes in accordance with a predetermined scanning pattern having three rows and n columns (n is an integer greater than or equal to 3) n times in a vertical scanning period;

at each selection, applying selection voltages in accordance with three column elements of the scanning pattern, the column elements corresponding to the selection, to the three scanning electrodes, respectively;

in each selection period in which three of the scanning electrodes are selected, comparing the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and generating conversion data in accordance with comparison results; and in the selection period, applying a first voltage to the signal electrode for a period of duration in accordance with conversion data, and applying a second voltage differing from the first voltage to the signal electrode for a remaining period.

12. A driving circuit for an electro-optical device for causing pixels at the intersections of scanning electrodes and signal electrodes to perform gray-scale display based on pieces of gray-scale data, each piece being formed of a plurality of bits, comprising:

a scanning-electrode driving circuit that selects three of the scanning electrodes in accordance with a predetermined scanning pattern having three rows and n columns (n is an integer greater than or equal to 3) n times in a vertical scanning period;

at each selection, applies selection voltages in accordance with three column elements of the scanning pattern, the column elements corresponding to the selection, to the three scanning electrodes, respectively;

a conversion-data output circuit that compares, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputs conversion data in accordance with the comparison results; and a voltage applying circuit that applies, in the selection period, a first voltage to the signal electrode for a period of duration in accordance with the conversion data and applies a second voltage differing from the first voltage to the signal electrode for a remaining period.

13. An electro-optical device for causing pixels at the intersections of scanning electrodes and signal electrodes to perform gray-scale display based on pieces of gray-scale data, each piece being formed of a plurality of bits, comprising:

a scanning-electrode driving circuit that selects three of the scanning electrodes in accordance with a predetermined scanning pattern having three rows and n columns (n is an integer greater than or equal to 3) n times in a vertical scanning period, and, at each selection, applies selection voltages in accordance with three column elements of the scanning pattern, the column elements corresponding to the selection, to the three scanning electrodes, respectively;

a conversion-data output circuit that compares, in each selection period in which three of the scanning electrodes are selected, the bits of a bit string in accordance with the column elements of the scanning pattern, the column elements corresponding to the selection, with the corresponding bits of each of a plurality of bit strings, each bit string being formed of a bit in each position of the pieces of gray-scale data for the three pixels at the intersections of the signal electrode and the three scanning electrodes, and outputs conversion data in accordance with the comparison results; and a voltage applying circuit that applies, in the selection period, a first voltage to the signal electrode for a period of duration in accordance with the conversion data and applies a second voltage differing from the first voltage to the signal electrode for a remaining period.

14. An electronic apparatus comprising the liquid crystal device as set forth in claim 10.

15. An electronic apparatus comprising the electro-optical device as set forth in claim 13.

* * * * *